US010647116B2

(12) United States Patent
Kobayashi

(10) Patent No.: US 10,647,116 B2
(45) Date of Patent: May 12, 2020

(54) LIQUID EJECTION HEAD AND RECORDING APPARATUS

(71) Applicant: KYOCERA Corporation, Kyoto-shi, Kyoto (JP)

(72) Inventor: Naoki Kobayashi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 16/335,613

(22) PCT Filed: Sep. 20, 2017

(86) PCT No.: PCT/JP2017/033900

§ 371 (c)(1),
(2) Date: Mar. 21, 2019

(87) PCT Pub. No.: WO2018/056304

PCT Pub. Date: Mar. 29, 2018

(65) Prior Publication Data

US 2019/0299613 A1 Oct. 3, 2019

(30) Foreign Application Priority Data

Sep. 23, 2016 (JP) ..... 2016-185411

(51) Int. Cl.
*B41J 2/14* (2006.01)
*B41J 2/175* (2006.01)
(Continued)

(52) U.S. Cl.
CPC ..... *B41J 2/14201* (2013.01); *B41J 2/04581* (2013.01); *B41J 2/14* (2013.01);
(Continued)

(58) Field of Classification Search
CPC ... B41J 2/14201; B41J 2/14; B41J 2/18; B41J 2/175; B41J 2/04581; B41J 2202/11;
(Continued)

(56) References Cited

U.S. PATENT DOCUMENTS

2008/0198208 A1 8/2008 Kyoso et al.
2015/0258789 A1* 9/2015 Togashi ..... B41J 2/14201 347/44
2018/0264837 A1* 9/2018 Matsuo ..... B41J 2/185

FOREIGN PATENT DOCUMENTS

JP 2008-200902 A 9/2008

* cited by examiner

*Primary Examiner* — Scott A Richmond
(74) *Attorney, Agent, or Firm* — Volpe and Koenig, P.C.

(57) ABSTRACT

A first flow path member of a liquid ejection head includes a plurality of pressurizing chambers connected to a plurality of ejection holes, a plurality of first individual flow paths connected to the plurality of pressurizing chambers, a plurality of second individual flow paths and a plurality of third individual flow paths, a first common flow path connected in common to the plurality of first and second individual flow paths, and a second common flow path connected in common to the plurality of third individual flow paths. A length from an area centroid of a surface pressurized by a displacement element in the pressurizing chamber to the area centroid via the first individual flow path, first common flow path, and second individual flow path in this order is longer than twice a length from the area centroid to the second common flow path via the third individual flow path.

7 Claims, 12 Drawing Sheets

(51) Int. Cl.
*B41J 2/045* (2006.01)
*B41J 2/18* (2006.01)

(52) U.S. Cl.
CPC ..... *B41J 2/175* (2013.01); *B41J 2/18* (2013.01); *B41J 2002/14306* (2013.01); *B41J 2002/14467* (2013.01); *B41J 2202/11* (2013.01)

(58) Field of Classification Search
CPC .... B41J 2002/14467; B41J 2002/14306; B41J 2/14209; B41J 2202/12; B41J 2002/14419; B41J 2002/14459; B41J 2002/14491; B41J 2002/14362
See application file for complete search history.

LIQUID EJECTION HEAD AND RECORDING APPARATUS

TECHNICAL FIELD

This disclosure relates to a liquid ejection head and a recording apparatus.

BACKGROUND ART

For example, in the related art, a liquid ejection head is known as a printing head which performs printing in various ways by ejecting a liquid onto a recording medium. For example, the liquid ejection head includes a flow path member and a plurality of pressurizing units. For example, a flow path member disclosed in PTL 1 includes a plurality of ejection holes, a plurality of pressurizing chambers respectively connected to the plurality of ejection holes, a plurality of first individual flow paths respectively connected to the plurality of pressurizing chambers, a plurality of second individual flow paths respectively connected to the plurality of pressurizing chambers, and a common flow path connected in common to the plurality of first individual flow paths and the plurality of second individual flow paths. The plurality of pressurizing units respectively pressurizes the plurality of pressurizing chambers.

CITATION LIST

Patent Literature

PTL 1: Japanese Unexamined Patent Application Publication No. 2008-200902

SUMMARY OF INVENTION

A liquid ejection head according to an aspect of this disclosure includes a flow path member and a plurality of pressurizing units. The flow path member includes a plurality of ejection holes, a plurality of pressurizing chambers respectively connected to the plurality of ejection holes, a plurality of first flow paths respectively connected to the plurality of pressurizing chambers, a plurality of second flow paths respectively connected to the plurality of pressurizing chambers, a plurality of third flow paths respectively connected to the plurality of pressurizing chambers, a fourth flow path connected in common to the plurality of first flow paths and the plurality of second flow paths, and a fifth flow path connected in common to the plurality of third flow paths. The plurality of pressurizing units each pressurizes a liquid inside the plurality of pressurizing chambers. A first length from an area centroid of a surface pressurized by the pressurizing unit in the pressurizing chamber to the area centroid via the first flow path, the fourth flow path, and the second flow path in this order is longer than twice a second length from the area centroid to the fifth flow path via the third flow path.

A recording apparatus according to another aspect of this disclosure includes the liquid ejection head, a transport unit that transports a recording medium to the liquid ejection head, and a control unit that controls the liquid ejection head.

BRIEF DESCRIPTION OF DRAWINGS

FIG. 12 illustrates a liquid ejection head according to a second embodiment.

DESCRIPTION OF EMBODIMENTS

Figure 1A:
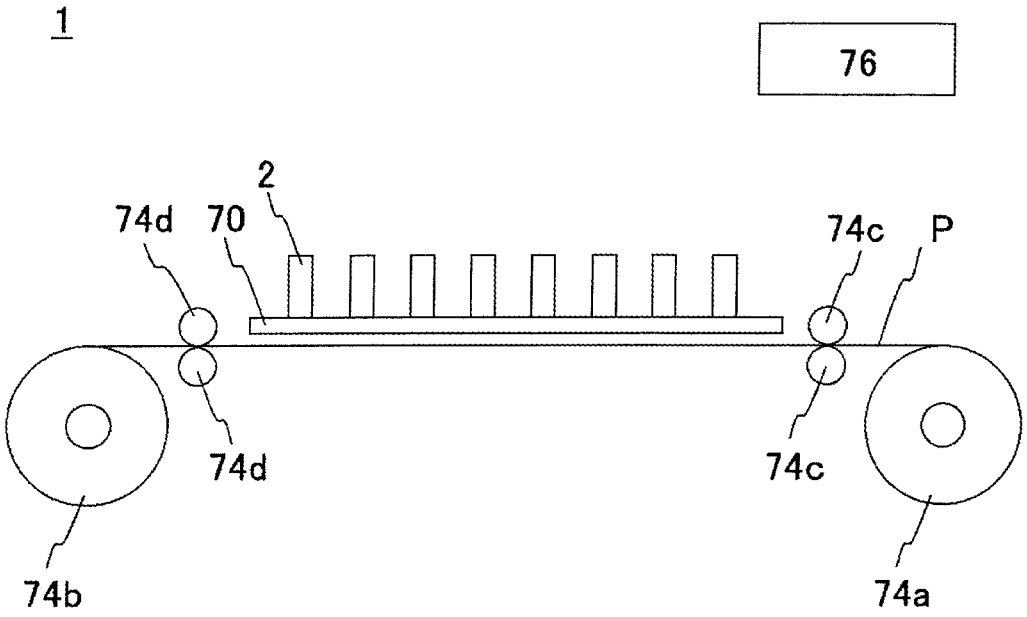
FIG. 1A is a side view schematically illustrating a recording apparatus including a liquid ejection head according to a first embodiment.

Hereinafter, embodiments according to this disclosure will be described with reference to the drawings. The drawings used in the following description are schematically illustrated, and dimensional ratios on the drawings do not necessarily coincide with actual ratios. Even in a plurality of drawings illustrating the same member, in some cases, the dimensional ratios may not coincide with each other in order to exaggeratingly illustrate a shape thereof.

Subsequently to a second embodiment, reference numerals given to configurations according to the previously described embodiment will be given to configurations which are the same as or similar to the configurations according to the previously described embodiment, and description thereof may be omitted in some cases. Even when reference numerals different from those of the configurations according to the previously described embodiment are given to configurations corresponding (similar) to the configurations according to the previously described embodiment, items which are not particularly specified are the same as those of the configurations according to the previously described embodiment.

First Embodiment (Overall Configuration of Printer)

Referring to FIG. 1, a color inkjet printer 1 (hereinafter, referred to as a printer 1) including a liquid ejection head 2 according to a first embodiment will be described.

The printer 1 moves a recording medium P relative to the liquid ejection head 2 by transporting the recording medium P from a transport roller 74*a* to a transport roller 74*b*. A control unit 76 controls the liquid ejection head 2, based on image or character data. In this manner, a liquid is ejected toward the recording medium P, a droplet is caused to land on the recording medium P, and printing is performed on the recording medium P.

In the present embodiment, the liquid ejection head 2 is fixed to the printer 1, and the printer 1 is a so-called line printer. Another embodiment of a recording apparatus is a so-called serial printer.

A flat plate-shaped head mounting frame 70 is fixed to the printer 1 so as to be substantially parallel to the recording medium P. Twenty holes (not illustrated) are disposed in the head mounting frame 70, and twenty liquid ejection heads 2 are mounted on the respective holes. The five liquid ejection heads 2 configure one head group 72, and the printer 1 has four head groups 72.

Figure 1B:
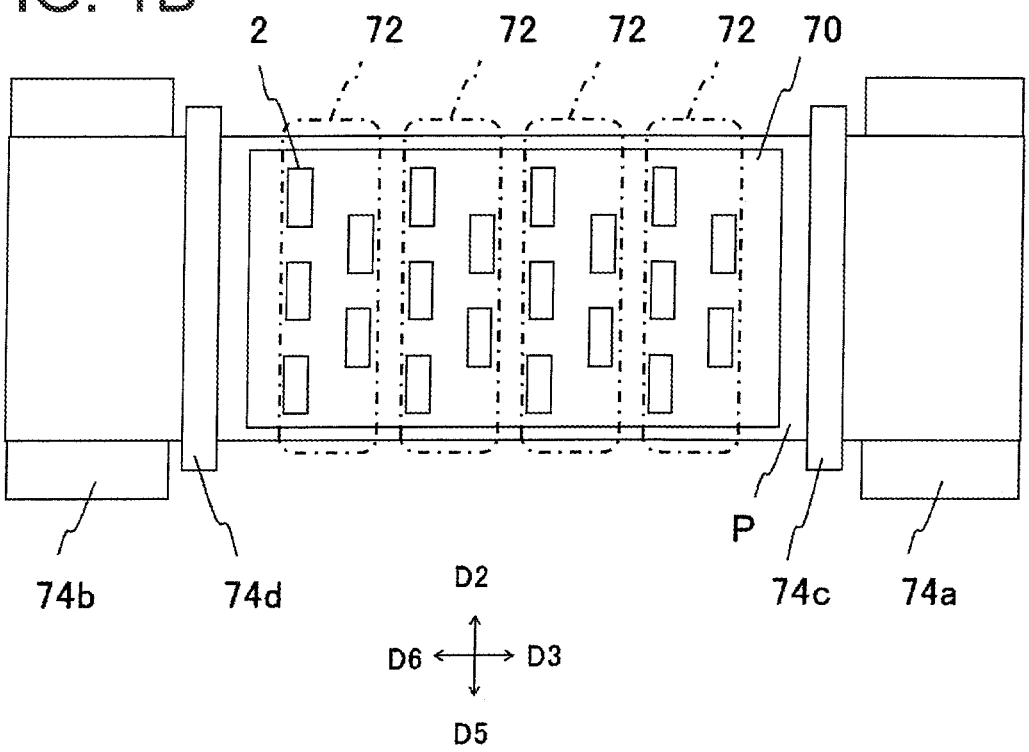
FIG. 1B is a plan view schematically illustrating the recording apparatus including the liquid ejection head according to the first embodiment.

The liquid ejection head 2 has an elongated shape as illustrated in FIG. 1B. Inside one head group 72, the three liquid ejection heads 2 are arrayed along a direction intersecting a transport direction of the recording medium P, the other two liquid ejection heads 2 are respectively arrayed one by one at positions shifted from each other along the transport direction among the three liquid ejection heads 2. The liquid ejection heads 2 adjacent to each other are arranged so that respective printable ranges of the liquid ejection heads 2 are linked to each other in a width direction of the recording medium P or respective edges overlap each other. Accordingly, it is possible to perform printing with no gap in the width direction of the recording medium P.

The four head groups 72 are arranged along the transport direction of the recording medium P. An ink is supplied from a liquid tank (not illustrated) to the respective liquid ejection heads 2. The same color ink is supplied to the liquid ejection heads 2 belonging to one head group 72, and the four head groups perform the printing using four color inks. For example, colors of the ink ejected from the respective head groups 72 are magenta (M), yellow (Y), cyan (C), and black (K).

The number of the liquid ejection heads 2 mounted on the printer 1 may be one as long as a printable range is printed using a single color and one liquid ejection head 2. The number of the liquid ejection heads 2 included in the head group 72 or the number of the head groups 72 can be appropriately changed depending on a printing target or a printing condition. For example, the number of the head groups 72 may be increased in order to further perform multicolor printing. Printing speed, that is, transport speed can be quickened by arranging the plurality of head groups 72 for performing the same color printing and alternately perform the printing in the transport direction. Alternatively, the plurality of head groups 72 for performing the same color printing may be prepared, and the head groups 72 may be arranged shifted from each other in a direction intersecting the transport direction. In this manner, resolution of the recording medium P in the width direction may be improved.

Furthermore, in addition to the color ink printing, a liquid such as a coating agent may be used in the printing in order to perform surface treatment on the recording medium P.

The printer 1 performs the printing on the recording medium P. The recording medium P is in a state of being wound around the transport roller 74*a*, and passes between two transport rollers 74*c*. Thereafter, the recording medium P passes through a lower side of the liquid ejection head 2 mounted on a head mounting frame 70. Thereafter, the recording medium P passes between two transport rollers 74*d*, and is finally collected by the transport roller 74*b*.

As the recording medium P, in addition to printing paper, cloth may be used. The printer 1 may adopt a form of transporting a transport belt instead of the recording medium P. In addition to a roll-type medium, the recording medium may be a sheet, cut cloth, wood or a tile placed on the transport belt. Furthermore, a wiring pattern of an electronic device may be printed by causing the liquid ejection head 2 to eject a liquid including conductive particles. Furthermore, chemicals may be prepared through a reaction process by causing the liquid ejection head 2 to eject a predetermined amount of a liquid chemical agent or a liquid containing the chemical agent toward a reaction container.

A position sensor, a speed sensor, or a temperature sensor may be attached to the printer 1, and the control unit 76 may control each unit of the printer 1 in accordance with a state of each unit of the printer 1 which is recognized based on information output from the respective sensors. In particular, if ejection characteristics (ejection amount or ejection speed) of the liquid ejected from the liquid ejection head 2 are externally affected, in accordance with temperature of the liquid ejection head 2, temperature of the liquid inside the liquid tank, or pressure applied to the liquid ejection head 2 by the liquid of the liquid tank, a drive signal for causing the liquid ejection head 2 to eject the liquid may be changed.

(Overall Configuration of Liquid Ejection Head)

Figure 5A:
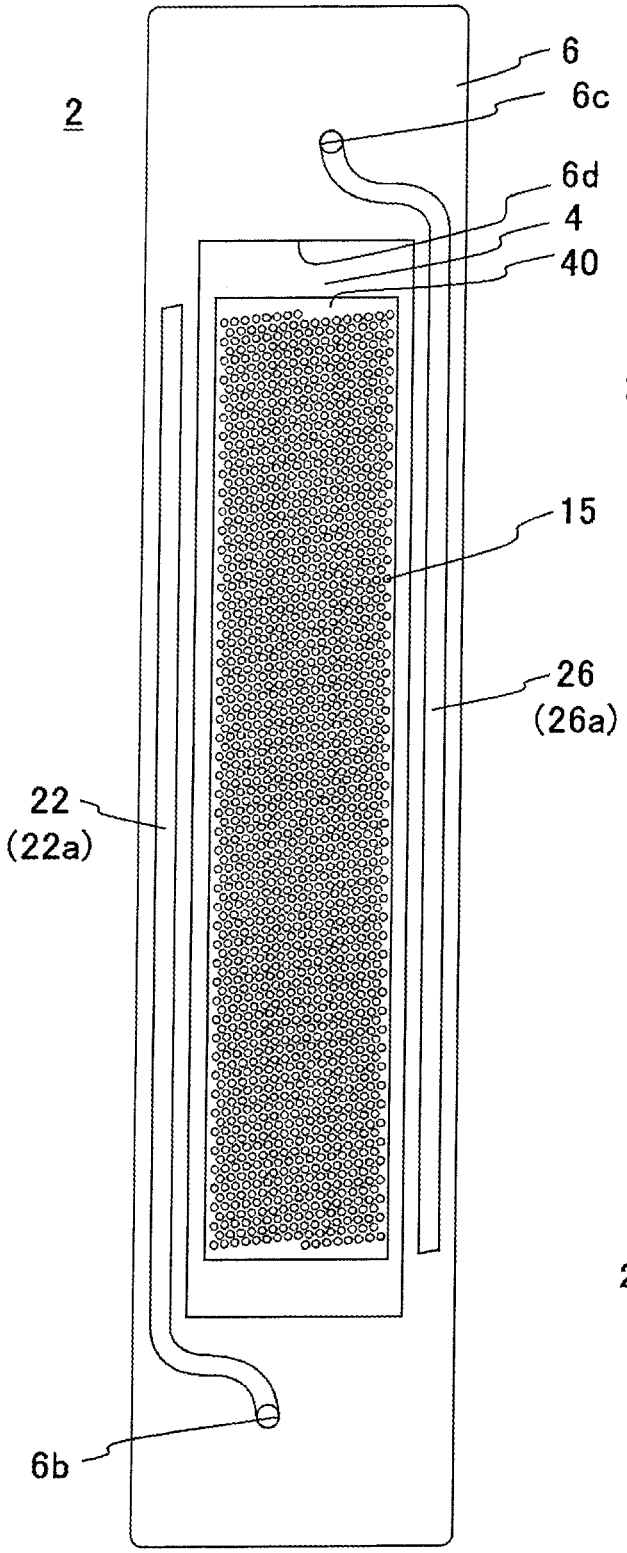
FIG. 5A is a plan view of the head body when a portion of the second flow path member is transparently viewed.
Figure 5B:
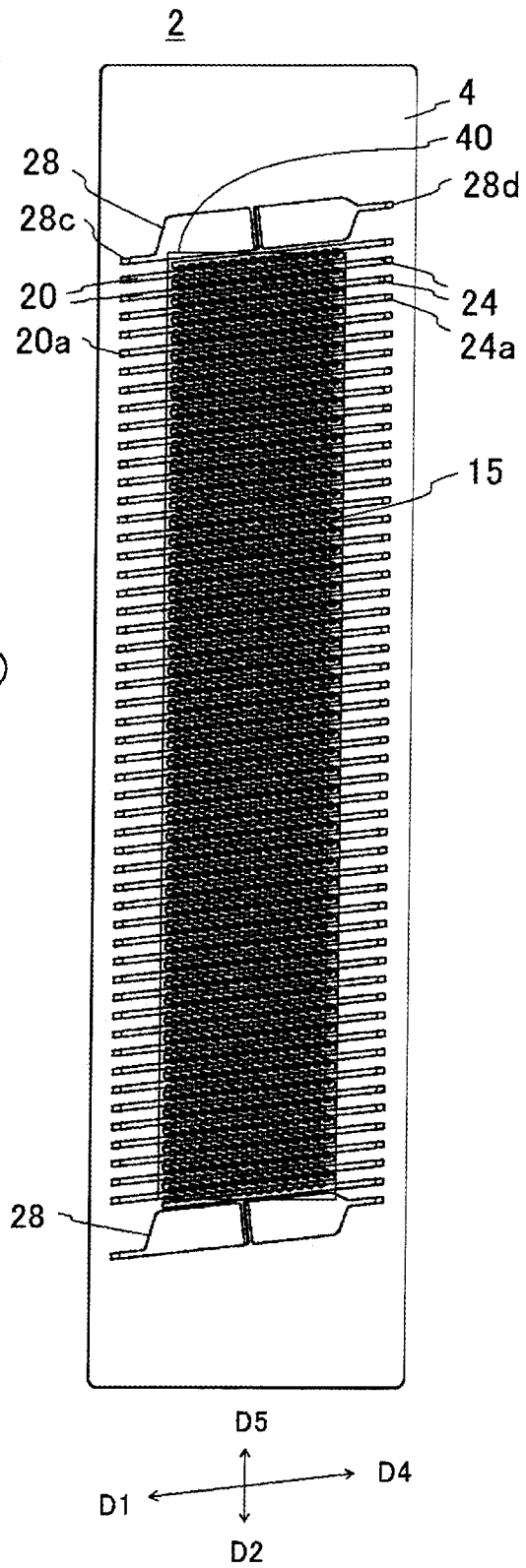
FIG. 5B is a plan view of the head body when the second flow path member is transparently viewed.
Figure 6:
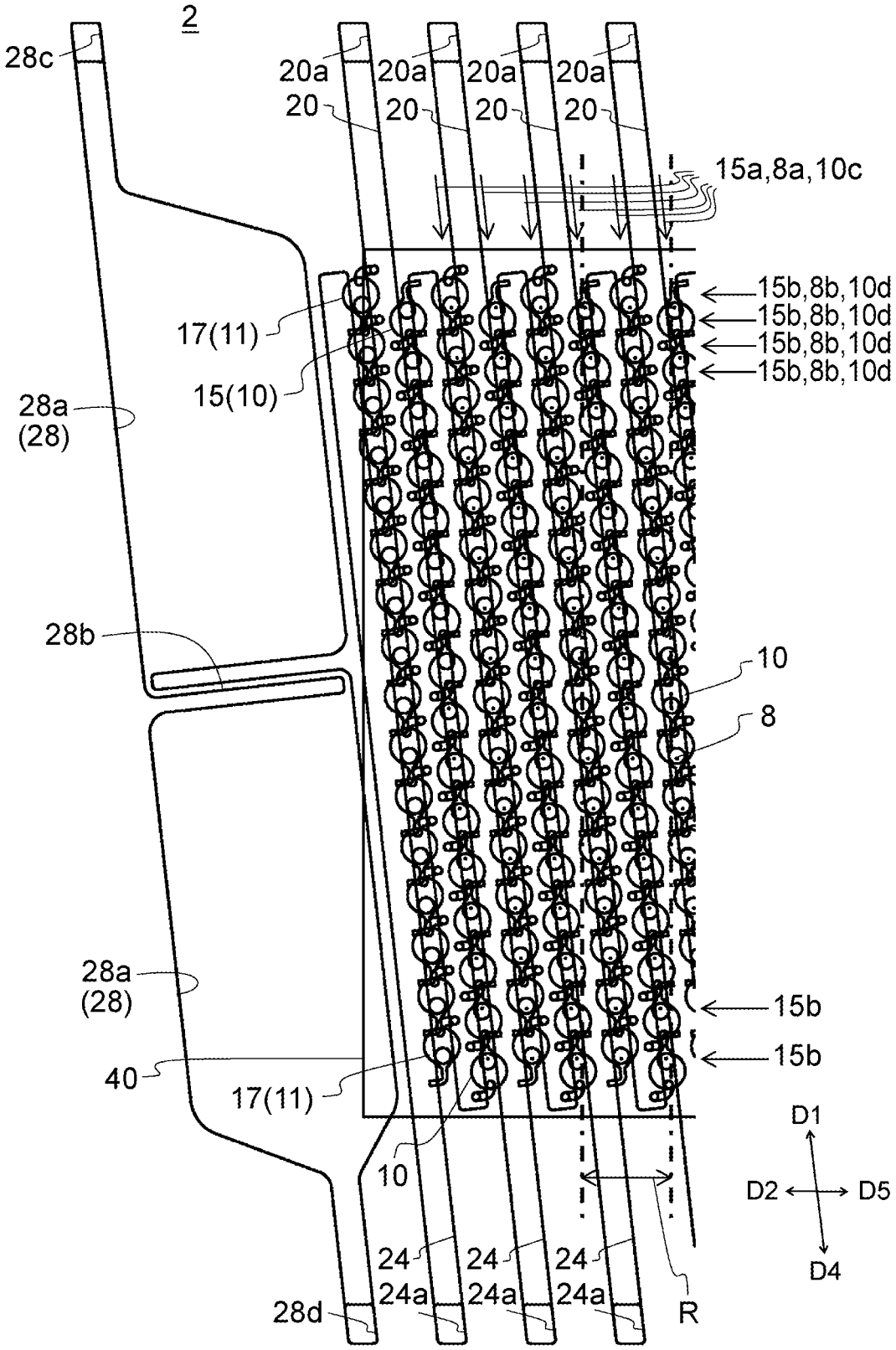
FIG. 6 is an enlarged plan view illustrating a portion in FIG. 5.

Next, the liquid ejection head 2 according to the first embodiment will be described with reference to FIGS. 2 to 9. In FIGS. 5 and 6, in order to facilitate understanding of the drawings, a flow path which is located below other members and needs to be illustrated using a broken line is illustrated using a solid line. FIG. 5A transparently illustrates a portion of a second flow path member 6, and FIG. 5B transparently illustrates the whole second flow path member 6. In FIG. 9, a flow of the liquid in the related art is illustrated using the broken line, a flow of the liquid in the ejection unit 15 is illustrated using the solid line, and a flow of the liquid supplied from a second individual flow path 14 is illustrated using a long broken line.

The drawings illustrate a first direction D1, a second direction D2, a third direction D3, a fourth direction D4, a fifth direction D5, and a sixth direction D6. The first direction D1 is oriented to one side in an extending direction of a first common flow path 20 and a second common flow path 24. The fourth direction D4 is oriented to the other side of the extending direction of the first common flow path 20 and the second common flow path 24. The second direction D2 is oriented to one side in an extending direction of a first integrated flow path 22 and a second integrated flow path 26. The fifth direction D5 is oriented to the other side in the extending direction of the first integrated flow path 22 and the second integrated flow path 26. The third direction D3 is oriented to one side in a direction perpendicular to the extending direction of the first integrated flow path 22 and the second integrated flow path 26. The sixth direction D6 is oriented to the other side in the direction perpendicular to the extending direction of the first integrated flow path 22 and the second integrated flow path 26.

The liquid ejection head 2 will be described with reference to a first individual flow path 12 as a first flow path, a second individual flow path 14 as a second flow path, a third individual flow path 16 as a third flow path, a first common flow path 20 as a fourth flow path, and a second common flow path 24 as a fifth flow path.

Figure 2:
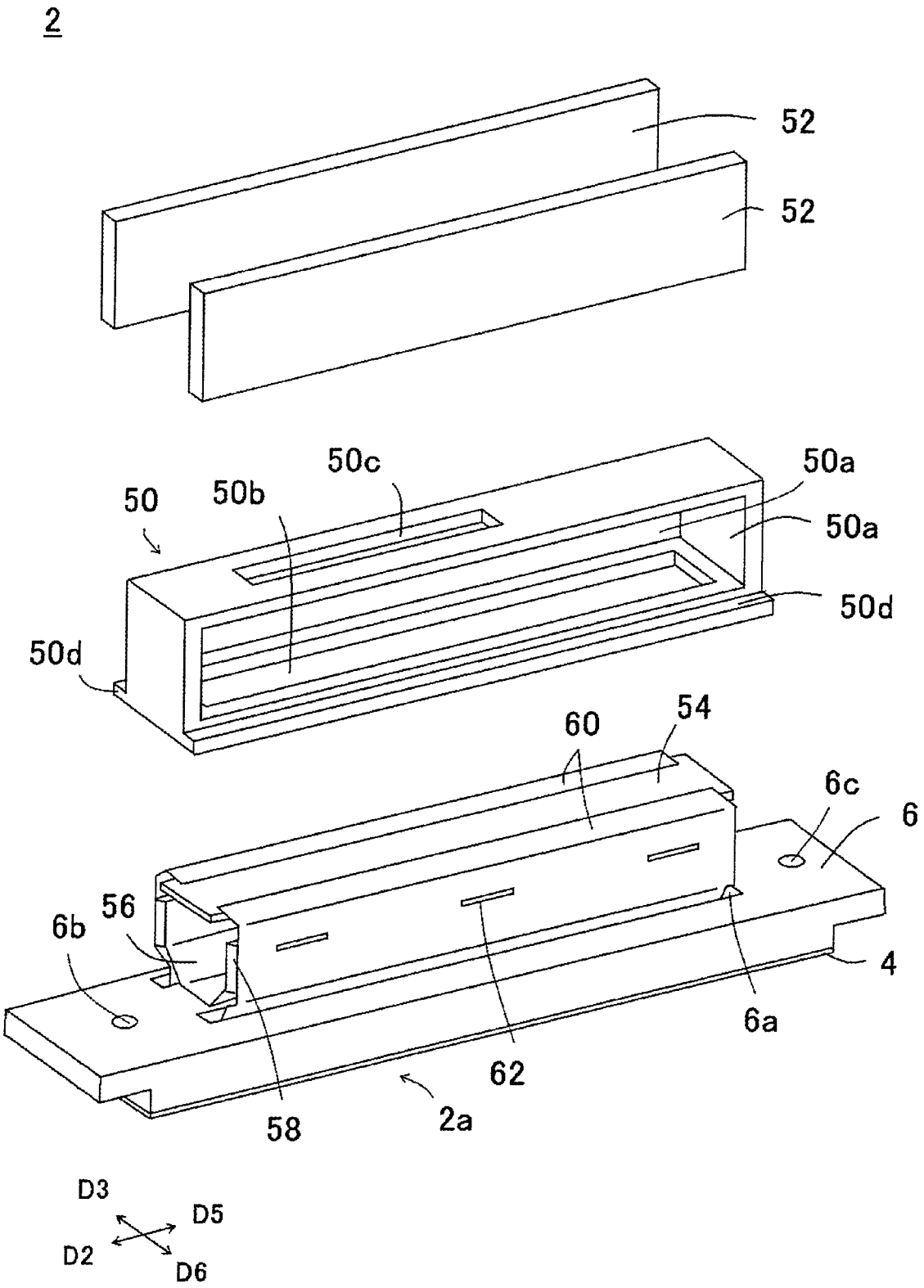
FIG. 2 is an exploded perspective view of the liquid ejection head according to the first embodiment.
Figure 3A:
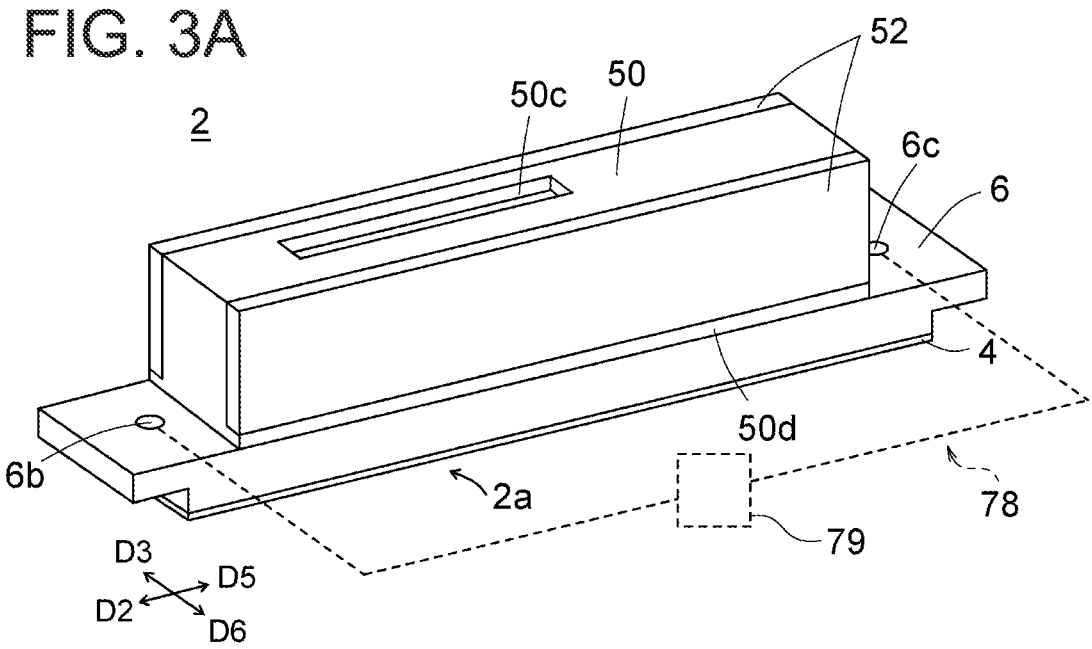
FIG. 3A is a perspective view of the liquid ejection head in FIG. 2.
Figure 3B:
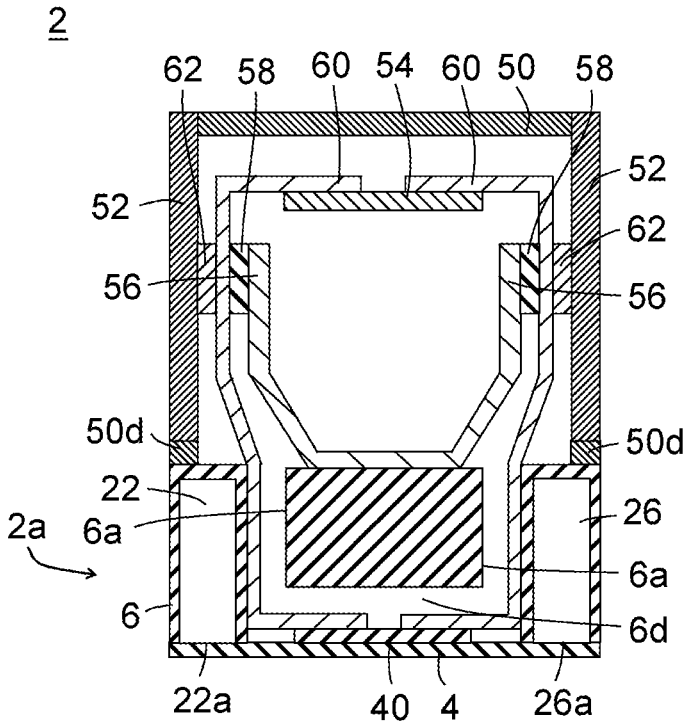
FIG. 3B is a sectional view of the liquid ejection head in FIG. 2.

As illustrated in FIGS. 2 and 3, the liquid ejection head 2 includes a head body 2*a*, a housing 50, a heat sink 52, a wiring board 54, a pressing member 56, an elastic member 58, a signal transmission unit 60, and a driver IC 62. The liquid ejection head 2 may include the head body 2*a*, and may not necessarily include the housing 50, the heat sink 52, the wiring board 54, the pressing member 56, the elastic member 58, the signal transmission unit 60, and the driver IC 62.

In the liquid ejection head 2, the signal transmission unit 60 is pulled out from the head body 2*a*, and the signal transmission unit 60 is electrically connected to the wiring board 54. The signal transmission unit 60 has the driver IC 62 for controlling the driving of the liquid ejection head 2. The driver IC 62 is pressed against the heat sink 52 by the pressing member 56 via the elastic member 58. A support member for supporting the wiring board 54 is omitted in the illustration.

The heat sink 52 can be formed of metal or an alloy, and is disposed in order to externally dissipate heat of the driver IC 62. The heat sink 52 is joined to the housing 50 by using a screw or an adhesive.

The housing 50 is placed on an upper surface of the head body 2*a*, and covers each member configuring the liquid ejection head 2 by using the housing 50 and the heat sink 52. The housing 50 includes a first opening 50*a*, a second opening 50*b*, a third opening 50*c*, and a heat insulator 50*d*. The first openings 50*a* are respectively disposed so as to face the third direction D3 and the sixth direction D6. Since the heat sink 52 is located in the first opening 50*a*, the first opening 50*a* is sealed. The second opening 50*b* is open downward, and the wiring board 54 and the pressing member 56 are located inside the housing 50 via the second opening 50*b*. The third opening 50*c* is open upward, and accommodates a connector (not illustrated) disposed in the wiring board 54.

The heat insulator 50*d* is disposed so as to extend in the fifth direction D5 from the second direction D2, and is located between the heat sink 52 and the head body 2*a*. In this manner, it is possible to reduce a possibility that the heat dissipated to the heat sink 52 may be transferred to the head body 2*a*. The housing 50 can be formed of metal, an alloy, or a resin.

Figure 4A:
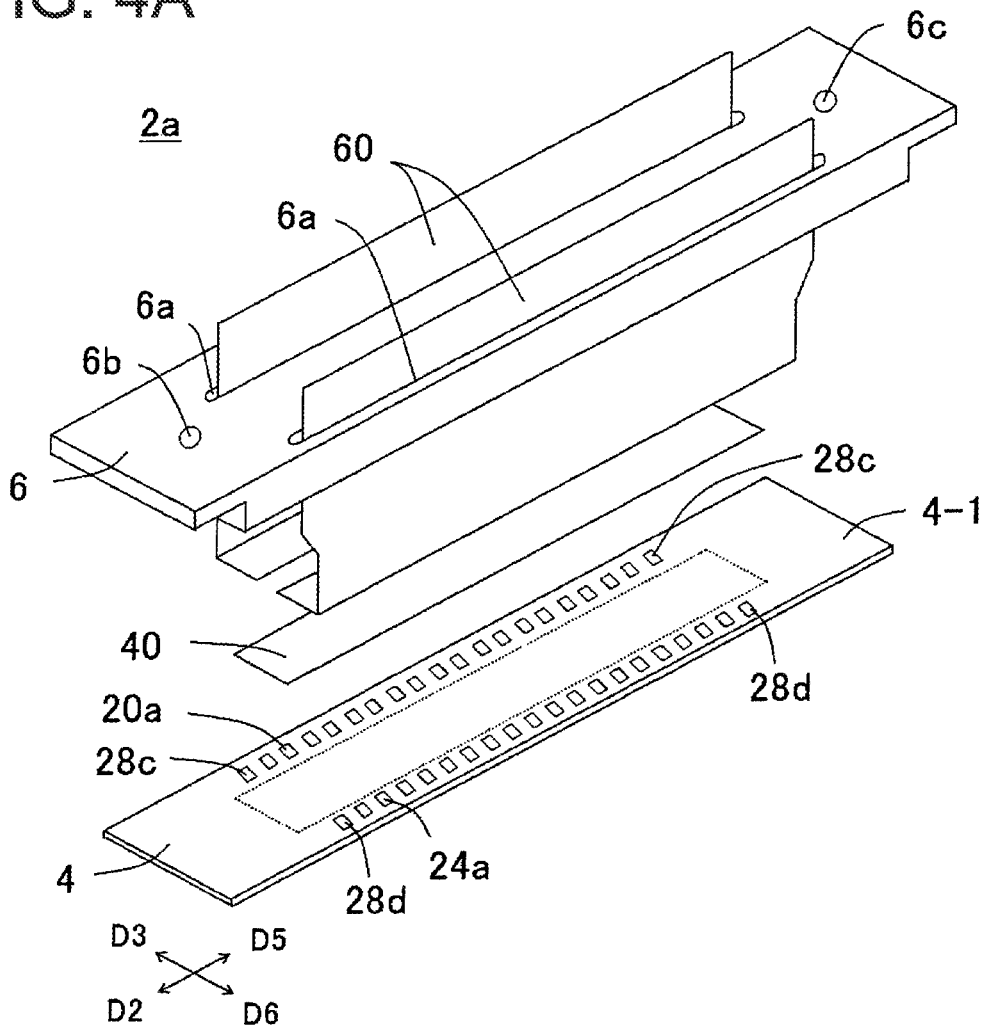
FIG. 4A is an exploded perspective view of a head body.

As illustrated in FIG. 4A, the head body 2*a* has a planar shape which is long from the second direction D2 toward the fifth direction D5, and has a first flow path member 4, a second flow path member 6, and a piezoelectric actuator board 40. In the head body 2*a*, the piezoelectric actuator board 40 and the second flow path member 6 are disposed on an upper surface of the first flow path member 4. The piezoelectric actuator board 40 is placed in a region illustrated using a broken line in FIG. 4A. The piezoelectric actuator board 40 is disposed in order to pressurize the plurality of pressurizing chambers 10 (refer to FIG. 8) disposed in the first flow path member 4, and has a plurality of displacement elements 48 (refer to FIG. 8).

(Overall Configuration of Flow Path Member)

The first flow path member 4 internally has a plurality of flow paths, and guides the liquid supplied from the second flow path member 6 to the ejection hole 8 (refer to FIG. 8) disposed on a lower surface. An upper surface of the first flow path member 4 serves as a pressurizing chamber surface 4-1, and openings 20*a*, 24*a*, 28*c*, and 28*d* are formed in the pressurizing chamber surface 4-1. The plurality of openings 20*a* is disposed, and is arrayed along the fifth direction D5 from the second direction D2. The opening 20*a* is located in an end portion in the third direction D3 of the pressurizing chamber surface 4-1. The plurality of openings 24*a* is disposed, and is arrayed along the fifth direction D5 from the second direction D2. The opening 24*a* is located in an end portion in the sixth direction D6 of the pressurizing chamber surface 4-1. The opening 28*c* is disposed outside the opening 20*a* in the second direction D2 and outside the opening 20*a* in the fifth direction D5. The opening 28*d* is disposed outside the opening 24*a* in the second direction D2 and outside the opening 24*a* in the fifth direction D5.

The second flow path member 6 internally has a plurality of flow paths, and guides the liquid supplied from the liquid tank to the first flow path member 4. The second flow path member 6 is disposed on an outer peripheral portion of the pressurizing chamber surface 4-1 of the first flow path member 4, and is joined to the first flow path member 4 via an adhesive (not illustrated) outside a placement region of the piezoelectric actuator board 40.

(Second Flow Path Member (Integrated Flow Path))

Figure 4B:
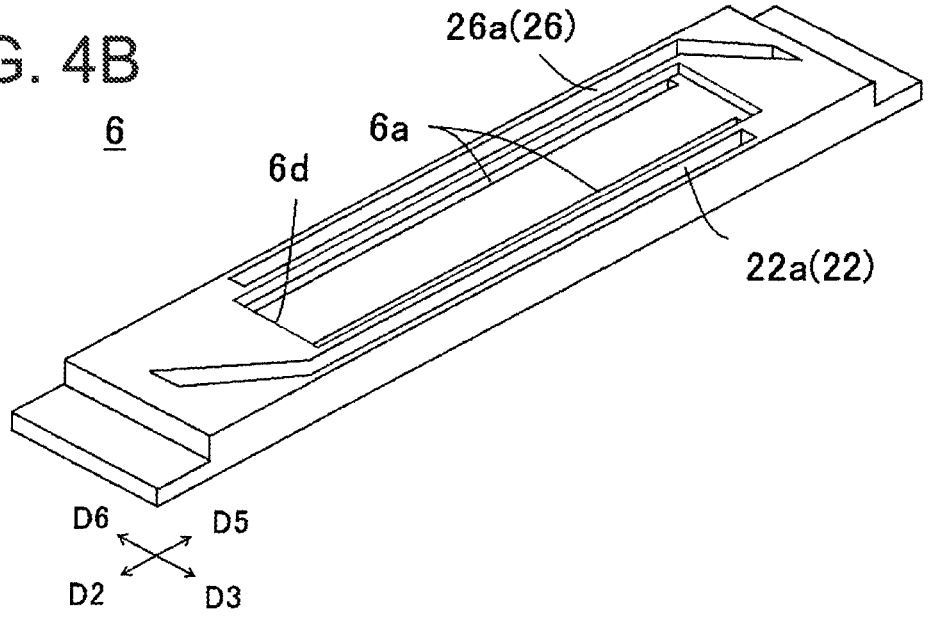
FIG. 4B is a perspective view when viewed from a lower surface of a second flow path member.

As illustrated in FIGS. 4 and 5, the second flow path member 6 has a through-hole 6*a* and openings 6*b*, 6*c*, 6*d*, 22*a*, and 26*a*. The through-hole 6*a* is formed so as to extend in the fifth direction D5 from the second direction D2, and is located outside the placement region of the piezoelectric actuator board 40. The signal transmission unit 60 is inserted into the through-hole 6*a*.

The opening 6*b* is disposed on the upper surface of the second flow path member 6, and is located in an end portion of the second flow path member in the second direction D2. The opening 6*b* supplies the liquid from the liquid tank to the second flow path member 6. The opening 6*c* is disposed on the upper surface of the second flow path member 6, and is located in an end portion of the second flow path member in the fifth direction D5. The opening 6*c* collects the liquid from the second flow path member 6 to the liquid tank. The opening 6*d* is disposed on the lower surface of the second flow path member 6, and the piezoelectric actuator board 40 is located in a space formed by the opening 6*d*.

The opening 22*a* is disposed on the lower surface of the second flow path member 6, and is disposed so as to extend in the fifth direction D5 from the second direction D2. The opening 22*a* is formed in an end portion of the second flow path member 6 in the third direction D3, and is disposed in the third direction D3 from the through-hole 6*a*.

The opening 22*a* communicates with the opening 6*b*. The opening 22*a* is sealed by the first flow path member 4, thereby forming the first integrated flow path 22. The first integrated flow path 22 is formed so as to extend in the fifth direction D5 from the second direction D2, and supplies the liquid to the opening 20*a* and the opening 28*c* of the first flow path member 4.

The opening 26*a* is disposed on the lower surface of the second flow path member 6, and is disposed so as to extend in the fifth direction D5 from the second direction D2. The opening 26*a* is formed in an end portion of the second flow path member 6 in the sixth direction D6, and is disposed in the sixth direction D6 from the through-hole 6*a*.

The opening 26*a* communicates with the opening 6*c*. The opening 26*a* is sealed by the first flow path member 4, thereby forming the second integrated flow path 26. The second integrated flow path 26 is formed so as to extend in the fifth direction D5 from the second direction D2, and collects the liquid from the opening 24*a* and the opening 28*d* of the first flow path member 4.

According to the above-described configuration, the liquid supplied from the liquid tank to the opening 6*b* is supplied to the first integrated flow path 22, and flows into the first common flow path 20 via the opening 22*a*. The liquid is supplied to the first flow path member 4. Then, the liquid collected by the second common flow path 24 flows into the second integrated flow path 26 via the opening 26*a*.

The liquid is collected outward via the opening 6*c*. The second flow path member 6 may not necessarily be disposed therein.

The liquid may be supplied and collected using any suitable means. For example, as illustrated using a dotted line in FIG. 3A, the printer 1 may have a circulation flow path 78 including the first integrated flow path 22, a flow path of the first flow path member 4, and the second integrated flow path 26, and a flow forming unit 79 forming a flow from the first integrated flow path 22 to the second integrated flow path 26 by way of a flow path of the first flow path member 4.

A configuration of the flow forming unit 79 may be appropriately adopted. For example, the flow forming unit 79 includes a pump, and suctions the liquid from the opening 6*c* and/or ejects the liquid to the opening 6*b*. For example, the flow forming unit 79 may have a collection space for storing the liquid collected from the opening 6*c*, a supply space for storing the liquid to be supplied to the opening 6*b*, and a pump for supplying the liquid to the supply space from the collection space. A liquid level of the supply space may be raised to be higher than a liquid level of the collection space. In this manner, a pressure difference may be generated between the first integrated flow path 22 and the second integrated flow path 26.

A portion located outside the first flow path member 4 and the second flow path member 6 in the circulation flow path 78 and the flow forming unit 79 may be a portion of the liquid ejection head 2, and may be disposed outside the liquid ejection head 2.

(First Flow Path Member (Common Flow Path and Ejection Unit))

As illustrated in FIGS. 5 to 8, the first flow path member 4 is formed by stacking a plurality of plates 4*a* to 4*m* one on another, and has a pressurizing chamber surface 4-1 disposed on the upper side and an ejection hole surface 4-2 disposed on the lower side when a cross section is viewed in a stacking direction. The piezoelectric actuator board 40 is placed on the pressurizing chamber surface 4-1, and the liquid is ejected from the ejection hole 8 which is open on the ejection hole surface 4-2. The plurality of the plates 4*a* to 4*m* can be formed of metal, an alloy, or a resin. The first flow path member 4 may be integrally formed of the resin without stacking the plurality of the plates 4*a* to 4*m* one on another.

The first flow path member 4 has the plurality of first common flow paths 20, the plurality of second common flow paths 24, a plurality of end portion flow paths 28, a plurality of ejection units 15, and a plurality of dummy ejection units 17.

The first common flow path 20 is disposed so as to extend in the fourth direction D4 from the first direction D1, and is formed so as to communicate with the opening 20*a*. The plurality of first common flow paths 20 is arrayed in the fifth direction D5 from the second direction D2. The first integrated flow path 22 and the plurality of first common flow paths 20 can be regarded as a manifold, and one single first common flow path 20 can be regarded as one branch flow path of the manifold.

The second common flow path 24 is disposed so as to extend in the first direction D1 from the fourth direction D4, and is formed so as to communicate with the opening 24*a*. The plurality of second common flow paths 24 is arrayed in the fifth direction D5 from the second direction D2, and is located between the first common flow paths 20 adjacent to each other. Therefore, the first common flow path 20 and the second common flow path 24 are alternately arranged from the second direction D2 toward the fifth direction D5. The second integrated flow path 26 and the plurality of second common flow paths 24 can be regarded as a manifold, and one single second common flow path 24 can be regarded as one branch flow path of the manifold.

A damper 30 is formed in the second common flow path 24 of the first flow path member 4, and a space 32 facing the second common flow path 24 is located via the damper 30. The damper 30 has a first damper 30*a* and a second damper 30*b*. The space 32 has a first space 32*a* and a second space 32*b*. The first space 32*a* is disposed above the second common flow path 24 through which the liquid flows via the first damper 30*a*. The second space 32*b* is disposed below the second common flow path 24 through which the liquid flows via the second damper 30*b*.

The first damper 30*a* is formed in substantially the whole region above the second common flow path 24. Therefore, in a plan view, the first damper 30*a* has a shape which is the same as that of the second common flow path 24. The first space 32*a* is formed in substantially the whole region above the first damper 30*a*. Therefore, in a plan view, the first space 32*a* has a shape which is the same as that of the second common flow path 24.

The second damper 30*b* is formed in substantially the whole region below the second common flow path 24. Therefore, in a plan view, the second damper 30*b* has a shape which is the same as that of the second common flow path 24. The second space 32*b* is formed in substantially the whole region below the second damper 30*b*. Therefore, in a plan view, the second space 32*b* has a shape which is the same as that of the second common flow path 24. The first flow path member 4 can mitigate pressure fluctuations of the second common flow path 24 by disposing the damper 30 in the second common flow path 24, and thus, fluid crosstalk is less likely to occur.

The first damper 30*a* and the first space 32*a* can be formed in such a way that grooves are formed in the plates 4*d* and 4*e* by means of half etching and the grooves are joined to face each other. In this case, a portion left by means of the half etching of the plate 4*e* serves as the first damper 30*a*. Similarly, the second damper 30*b* and the second space 32*b* can be manufactured in such a way that the grooves are formed in the plates 4*k* and 4*l* by means of the half etching.

The end portion flow path 28 is formed in an end portion of the second direction D2 of the first flow path member 4 and an end portion in the fifth direction D5. The end portion flow path 28 has a wide portion 28*a*, a narrow portion 28*b*, and openings 28*c* and 28*d*. The liquid supplied from the opening 28*c* flows into the end portion flow path 28 by flowing through the wide portion 28*a*, the narrow portion 28*b*, the wide portion 28*a*, and the opening 28*d* in this order. In this manner, the liquid is present in the end portion flow path 28, and the liquid flows into the end portion flow path 28. Accordingly, the temperature of the first flow path member 4 located around the end portion flow path 28 is allowed to be uniform by the liquid. Therefore, it is possible to reduce a possibility that the first flow path member 4 may be dissipated from the end portion in the second direction D2 and the end portion in the fifth direction D5.

(Ejection Unit)

Figure 7A:
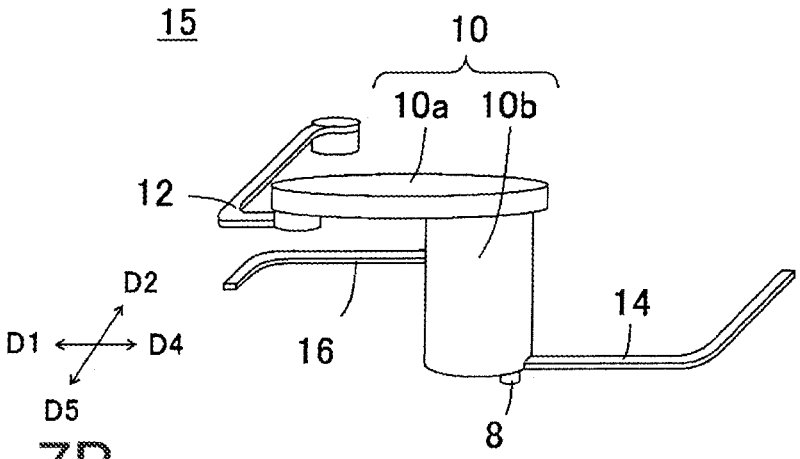
FIG. 7A is a perspective view of an ejection unit.

Referring to FIGS. 6 and 7, the ejection unit 15 will be described. The ejection unit 15 has the ejection hole 8, the pressurizing chamber 10, the first individual flow path (first flow path) 12, the second individual flow path (second flow path) 14, and the third individual flow path (third flow path) 16. In the liquid ejection head 2, the liquid is supplied from the first individual flow path 12 and the second individual flow path 14 to the pressurizing chamber 10, and the third individual flow path 16 collects the liquid from the pressurizing chamber 10. As will be described in detail later, flow path resistance of the second individual flow path 14 is lower than flow path resistance of the first individual flow path 12.

The ejection unit 15 is disposed between the first common flow path 20 and the second common flow path 24 which are adjacent to each other, and is formed in a matrix form in a plane direction of the first flow path member 4. The ejection unit 15 has an ejection unit column 15*a* and an ejection unit row 15*b*. In the ejection unit column 15*a*, the ejection units 15 are arrayed from the first direction D1 toward the fourth direction D4. In the ejection unit row 15*b*, the ejection units 15 are arrayed from the second direction D2 toward the fifth direction D5.

The pressurizing chamber 10 has a pressurizing chamber column 10*c* and a pressurizing chamber row 10*d*. The ejection hole 8 has an ejection hole column 8*a* and an ejection hole row 8*b*. Similarly, the ejection hole column 8*a* and the pressurizing chamber column 10*c* are arrayed from the first direction D1 toward the fourth direction D4. Similarly, the ejection hole row 8*b* and the pressurizing chamber row 10*d* are arrayed from the second direction D2 toward the fifth direction D5.

An angle formed between the first direction D1 and the fourth direction D4 and an angle formed between the second direction D2 and the fifth direction D5 are shifted from a right angle. Therefore, the ejection holes 8 belonging to the ejection hole column 8*a* arrayed along the first direction D1 are arranged so as to be shifted from each other in the second direction D2 as much as the shifted amount from the right angle. The ejection hole column 8*a* is located parallel to the second direction D2. Accordingly, the ejection holes 8 belonging to the different ejection hole column 8*a* are arranged so as to be shifted from each other in the second direction D2 as much as the shifted amount. In combination thereof, the ejection holes 8 of the first flow path member 4 are arranged at a regular interval in the second direction D2. In this manner, the printing can be performed so as to fill a predetermined range with pixels formed by the ejected liquid.

In FIG. 6, if the ejection hole 8 is projected in the third direction D3 and the sixth direction D6, thirty-two ejection holes 8 are projected in a range of a virtual straight line R, and the respective ejection holes 8 are arrayed at an interval of 360 dpi inside the virtual straight line R. In this manner, if the recording medium P is transported and printed in a direction perpendicular to the virtual straight line R, the printing can be performed using a resolution of 360 dpi.

The dummy ejection unit 17 is disposed between the first common flow path 20 located closest in the second direction D2 and the second common flow path 24 located closest in the second direction D2. The dummy ejection unit 17 is also disposed between the first common flow path 20 located closest in the fifth direction D5 and the second common flow path 24 located closest in the fifth direction D5. The dummy ejection unit 17 is disposed in order to stabilize the ejection of the ejection unit column 15*a* located closest in the second direction D2 or the fifth direction D5.

Figure 7B:
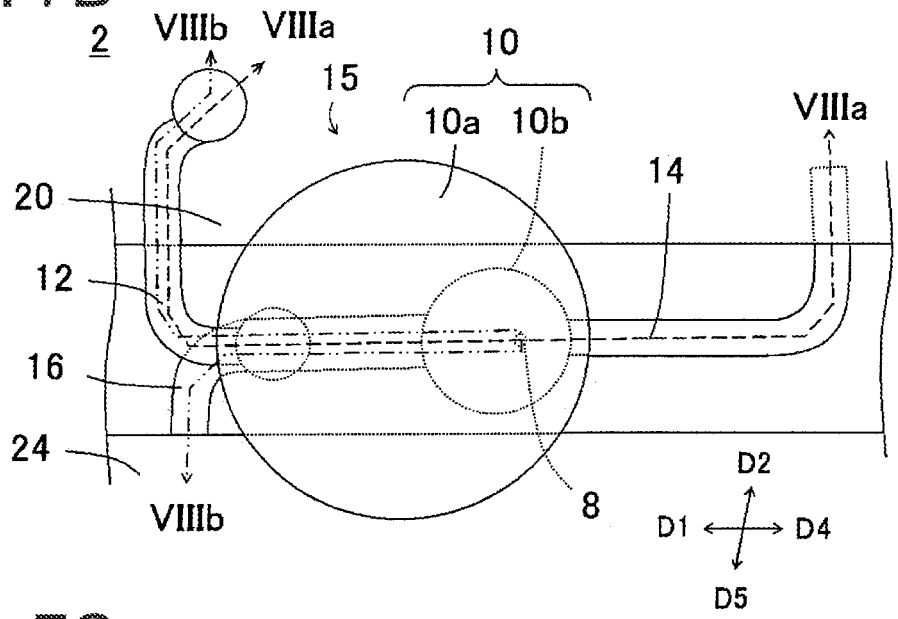
FIG. 7B is a plan view of the ejection unit.
Figure 7C:
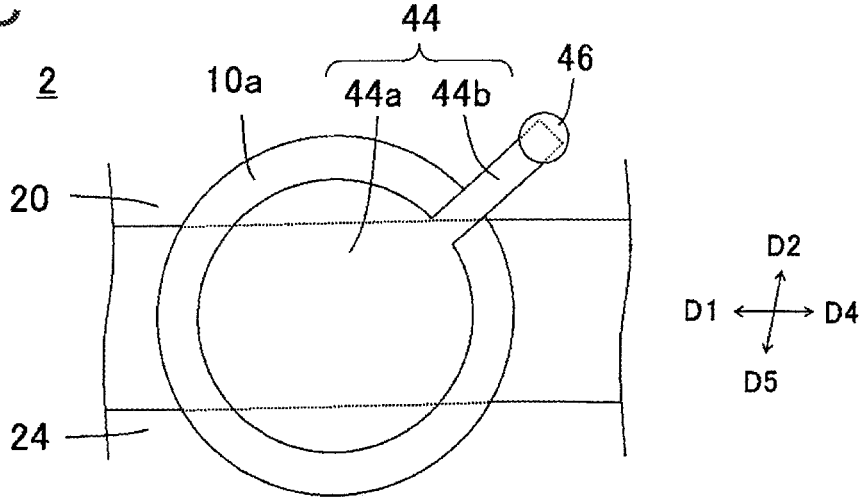
FIG. 7C is a plan view illustrating an electrode on the ejection unit.
Figure 8A:
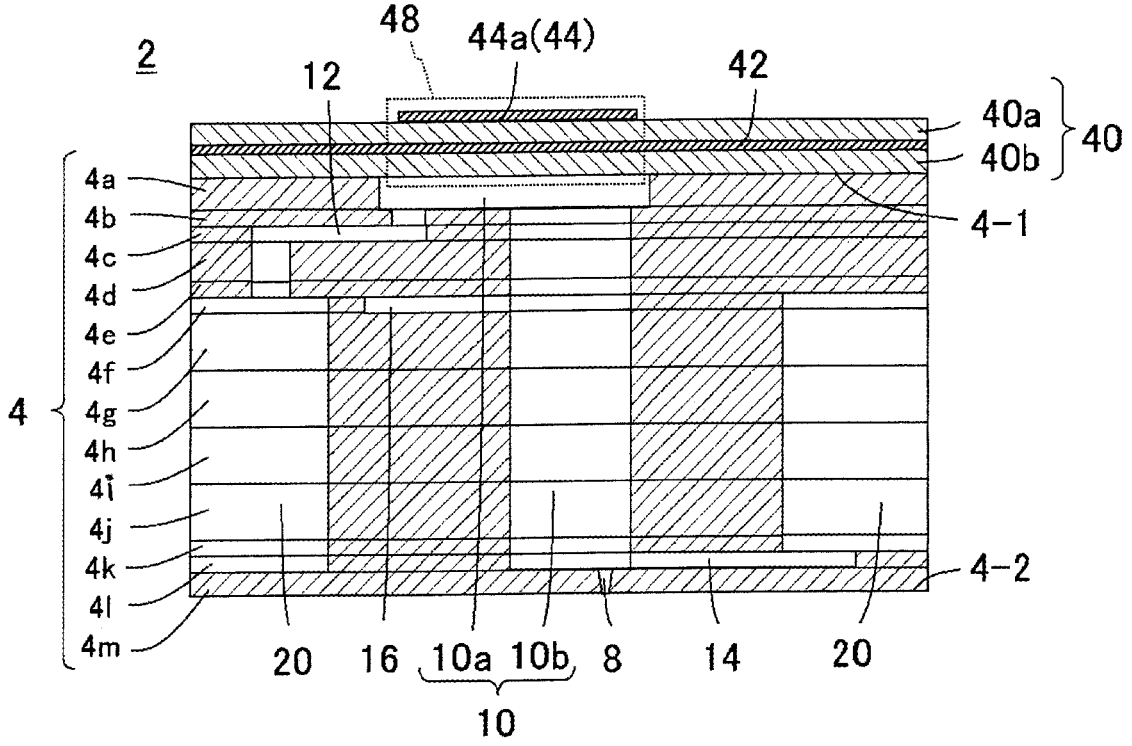
FIG. 8A is a sectional view taken along line Villa-Villa in FIG. 7B.
Figure 8B:
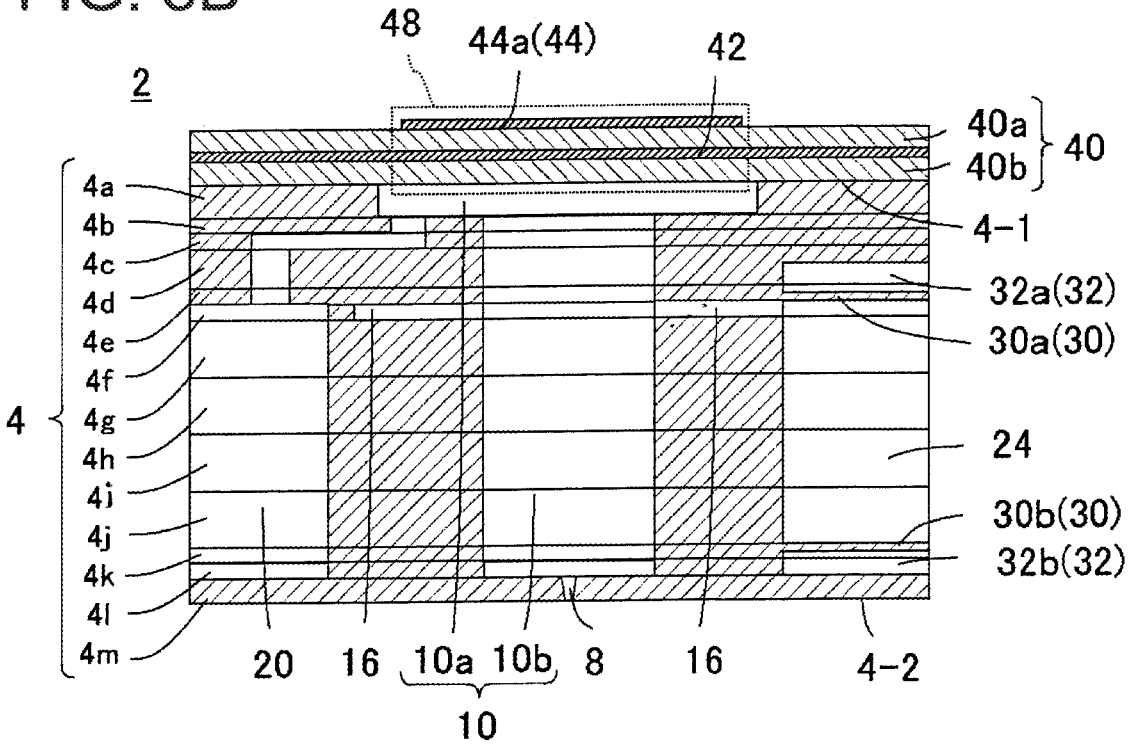
FIG. 8B is a sectional view taken along line VIIIb-VIIIb in FIG. 7B.
Figure 9:
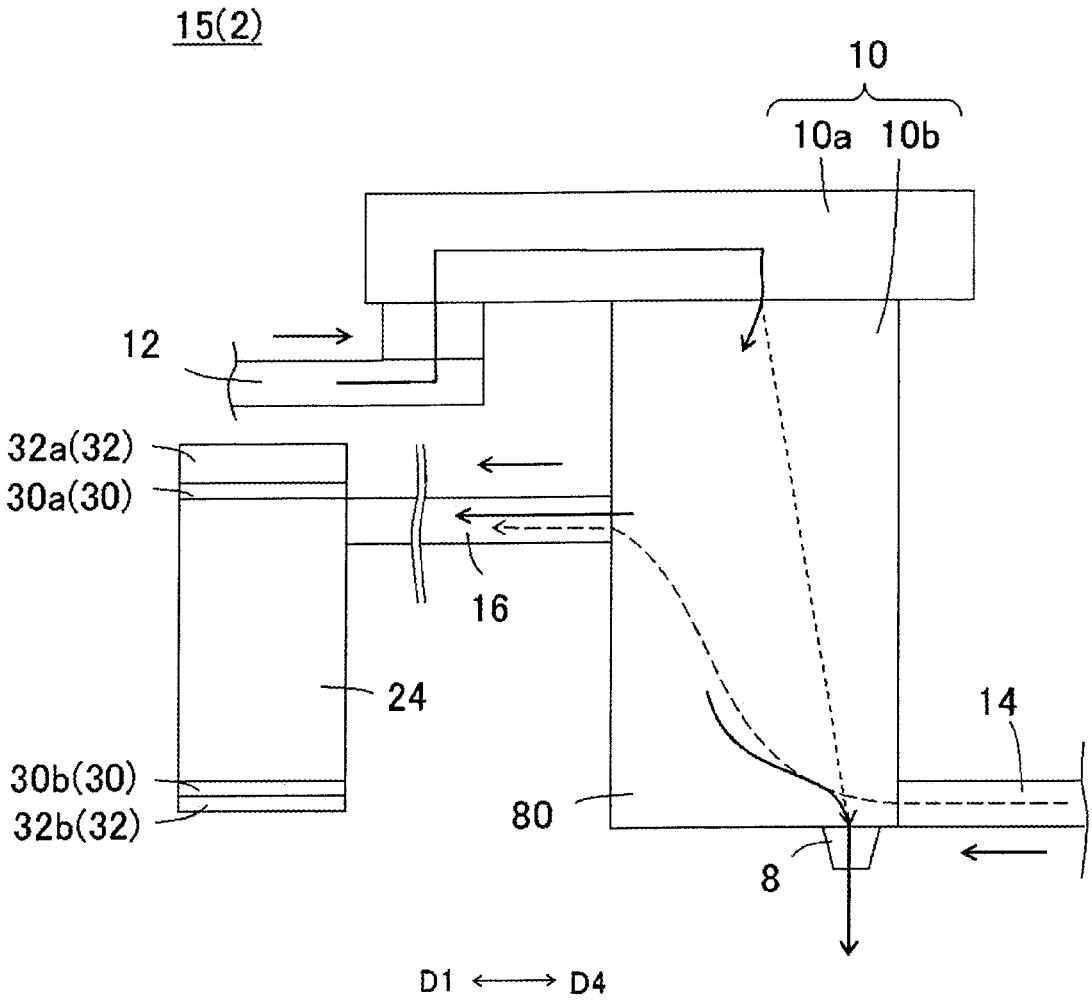
FIG. 9 is a conceptual diagram illustrating a flow of a fluid inside a liquid ejection unit.

As illustrated in FIGS. 7 and 8, the pressurizing chamber 10 has a pressurizing chamber body 10*a* and a partial flow path 10*b*. The pressurizing chamber body 10*a* has a circular shape in a plan view, and the partial flow path 10*b* extends downward from the pressurizing chamber body 10*a*. The pressurizing chamber body 10*a* pressurizes the liquid inside the partial flow path 10*b* by receiving pressure from the displacement element 48 disposed on the pressurizing chamber body 10*a*.

The pressurizing chamber body 10*a* has a substantially disc shape, and a planar shape thereof is circular. Since the planar shape is circular, it is possible to increase a volume change of the pressurizing chamber 10 which is caused by a displacement amount and displacement. The partial flow path 10*b* has a substantially cylindrical shape having a diameter which is smaller than that of the pressurizing chamber body 10*a*, and the planar shape is circular. The partial flow path 10*b* is accommodated inside the pressurizing chamber body 10*a* when viewed from the pressurizing chamber surface 4-1.

The partial flow path 10*b* may have a conical shape or a truncated conical shape whose sectional area decreases toward the ejection hole 8. In this manner, it is possible to increase the width of the first common flow path 20 and the second common flow path 24, and it is possible to reduce a difference in the above-described pressure loss.

The pressurizing chambers 10 are arranged along both sides of the first common flow path 20, and configure every one column on one side and total two columns of the pressurizing chamber column 10*c*. The first common flow path 20 and the pressurizing chambers 10 arrayed on both sides thereof are connected via the first individual flow path 12 and the second individual flow path 14.

The pressurizing chambers 10 are arranged along both sides of the second common flow path 24, and configure every one column on one side and total two columns of the pressurizing chamber column 10*c*. The second common flow path 24 and the pressurizing chambers 10 arrayed on both sides thereof are connected via the third individual flow path 16.

Referring to FIG. 7, the first individual flow path 12, the second individual flow path 14, and the third individual flow path 16 will be described.

The first individual flow path 12 connects the first common flow path 20 and the pressurizing chamber body 10*a* to each other. The first individual flow path 12 extends upward from the upper surface of the first common flow path 20, and thereafter, extends toward the fifth direction D5. The first individual flow path 12 extends toward the fourth direction D4. Thereafter, the first individual flow path 12 extends upward again, and is connected to the lower surface of the pressurizing chamber body 10*a*.

The second individual flow path 14 connects the first common flow path 20 and the partial flow path 10*b* to each other. The second individual flow path 14 extends toward the fifth direction D5 from the lower surface of the first common flow path 20, and extends toward the first direction D1. Thereafter, the second individual flow path 14 is connected to the side surface of the partial flow path 10*b*.

The third individual flow path 16 connects the second common flow path 24 and the partial flow path 10*b* to each other. The third individual flow path 16 extends toward the second direction D2 from the side surface of the second common flow path 24, and extends toward the fourth direction D4. Thereafter, the third individual flow path 16 is connected to the side surface of the partial flow path 10*b*.

The flow path resistance of the second individual flow path 14 is lower than the flow path resistance of the first individual flow path 12. In order to cause the flow path resistance of the second individual flow path 14 to be lower than the flow path resistance of the first individual flow path 12, for example, the thickness of the plate 4*l* having the second individual flow path 14 may be thickened than the thickness of the plate 4*c* having the first individual flow path 12. In a plan view, the width of the second individual flow path 14 may be wider than the width of the first individual flow path 12. In a plan view, the length of the second individual flow path 14 may be shorter than the length of the first individual flow path 12.

According to the above-described configuration, in the first flow path member 4, the liquid supplied to the first common flow path 20 via the opening 20*a* flows into the pressurizing chamber 10 via the first individual flow path 12 and the second individual flow path 14, and the liquid is partially ejected from the ejection hole 8. The remaining liquid flows from the pressurizing chamber 10 into the second common flow path 24 via the third individual flow path 16, and is discharged via the opening 24*a* from the first flow path member 4 to the second flow path member 6.

(Piezoelectric Actuator)

The piezoelectric actuator board 40 will be described with reference to FIGS. 7C and 8. The piezoelectric actuator board 40 including the displacement elements 48 is joined to the upper surface of the first flow path member 4, and the respective displacement elements 48 are arranged to be located on the pressurizing chamber 10. The piezoelectric actuator board 40 occupies a region having a shape which is substantially the same as that of the pressurizing chamber group formed by the pressurizing chamber 10. The opening of the respective pressurizing chambers 10 is closed by joining the piezoelectric actuator board 40 to the pressurizing chamber surface 4-1 of the first flow path member 4.

The piezoelectric actuator board 40 has a stacked structure having two piezoelectric ceramic layers 40*a* and 40*b* serving as piezoelectric bodies. The piezoelectric ceramic layers 40*a* and 40*b* respectively have the thickness of approximately 20 μm. Both layers of the piezoelectric ceramic layers 40*a* and 40*b* extend across the plurality of pressurizing chambers 10.

The piezoelectric ceramic layers 40*a* and 40*b* are formed of a ferroelectric material, for example, a ceramic material such as a lead zirconate titanate (PZT) system, a $NaNbO_3$ system, a $BaTiO_3$ system, a $(BiNa)NbO_3$ system, and a $BiNaNb_5O_{15}$ system. The piezoelectric ceramic layer 40*b* serves as a diaphragm, and does not necessarily need to be a piezoelectric body. Alternatively, another ceramic layer, a metal plate, or a resin plate which is not the piezoelectric body may be used. The diaphragm may be configured to be shared as a member configuring a portion of the first flow path member 4. For example, unlike the illustrated example, the diaphragm may have the width throughout the pressurizing chamber surface 4-1, and may have an opening facing the openings 20*a*, 24*a*, 28*c*, and 28*d*.

A common electrode 42, an individual electrode 44, and a connection electrode 46 are formed in the piezoelectric actuator board 40. The common electrode 42 is formed over a substantially entire surface in a plane direction in a region between the piezoelectric ceramic layer 40*a* and the piezoelectric ceramic layer 40*b*. The individual electrode 44 is located at a position facing the pressurizing chamber 10 on the upper surface of the piezoelectric actuator board 40.

A portion interposed between the individual electrode 44 and the common electrode 42 of the piezoelectric ceramic layer 40*a* is polarized in the thickness direction, and serves as the displacement element 48 having a unimorph structure which is displaced if a voltage is applied to the individual electrode 44. Therefore, the piezoelectric actuator board 40 has the plurality of displacement elements 48.

The common electrode 42 can be formed of a metal material such as an Ag—Pd system, and the thickness of the common electrode 42 can be set to approximately 2 μm. The common electrode 42 is connected to a surface electrode (not illustrated) for the common electrode on the piezoelectric ceramic layer 40*a* through a via-hole formed by penetrating the piezoelectric ceramic layer 40*a*, and is grounded via the surface electrode for the common electrode. In this manner, the common electrode 42 is held at a ground potential.

The individual electrode 44 is formed of a metal material such as an Au system, and has an individual electrode body 44*a* and a lead electrode 44*b*. As illustrated in FIG. 7C, the individual electrode body 44*a* is formed in a substantially circular shape in a plan view, and is formed to be smaller than the pressurizing chamber body 10*a*. The lead electrode 44*b* is pulled out from the individual electrode body 44*a*, and the connection electrode 46 is formed on the lead electrode 44*b* which is pulled out.

For example, the connection electrode 46 is made of silver-palladium including glass frit, and is formed in a projection shape having the thickness of approximately 15 μm. The connection electrode 46 is electrically connected to an electrode disposed in the signal transmission unit 60.

Under the control of the control unit 76, the liquid ejection head 2 displaces the displacement element 48 in accordance with a drive signal supplied to the individual electrode 44 via the driver IC 62. As a driving method, so-called pulling-type driving can be used.

(Details and Operation of Ejection Unit)

Referring to FIG. 9, the ejection unit 15 of the liquid ejection head 2 will be described in detail.

The ejection unit 15 includes the ejection hole 8, the pressurizing chamber 10, the first individual flow path (first flow path) 12, the second individual flow path (second flow path) 14, and the third individual flow path (third flow path) 16. The first individual flow path 12 and the second individual flow path 14 are connected to the first common flow path 20 (fourth flow path (refer to FIG. 8)). The third individual flow path 16 is connected to the second common flow path 24 (fifth flow path (refer to FIG. 8)).

The first individual flow path 12 is connected to the pressurizing chamber body 10*a* in the first direction D1 in the pressurizing chamber 10. The second individual flow path 14 is connected to the partial flow path 10*b* in the fourth direction D4 in the pressurizing chamber 10. The third individual flow path 16 is connected to the partial flow path 10*b* in the first direction D1 in the pressurizing chamber 10.

The liquid supplied from the first individual flow path 12 flows downward in the partial flow path 10*b* through the pressurizing chamber body 10*a*, and is partially ejected from the ejection hole 8. The liquid which is not ejected from the ejection hole 8 is collected outward from the ejection unit 15 via the third individual flow path 16.

The liquid supplied from the second individual flow path 14 is partially ejected from the ejection hole 8. The liquid which is not ejected from the ejection hole 8 flows upward inside the partial flow path 10*b*, and is collected outward from the ejection unit 15 via the third individual flow path 16.

As illustrated in FIG. 9, the liquid supplied from the first individual flow path 12 flows in the pressurizing chamber body 10*a* and the partial flow path 10*b*, and is ejected from the ejection hole 8. As illustrated using a broken line, the flow of the liquid in the ejection unit in the related art uniformly and substantially linearly flows toward the ejection hole 8 from the center portion of the pressurizing chamber body 10*a*.

According to the configuration, if the liquid flows in this way, the liquid is less likely to flow in the vicinity of a region 80 located opposite to a portion to which the second individual flow path 14 is connected in the pressurizing chamber 10. For example, there is a possibility that a region where the liquid stagnates may be generated in the vicinity of the region 80.

In contrast, in the ejection unit 15, the first individual flow path 12 and the second individual flow path 14 are connected to the pressurizing chamber 10, and the liquid is supplied to the pressurizing chamber 10 from these flow paths.

Therefore, the flow of the liquid supplied from the second individual flow path 14 to the pressurizing chamber 10 can be caused to collide with the flow of the liquid supplied from the first individual flow path 12 to the ejection hole 8. In this manner, the liquid supplied from the pressurizing chamber 10 to the ejection hole 8 is less likely to uniformly and substantially linearly flow. Accordingly, a configuration can be adopted in which the region where the liquid stagnates is less likely to appear inside the pressurizing chamber 10.

That is, a position of a liquid stagnation position caused by the flow of the liquid supplied from the pressurizing chamber 10 to the ejection hole 8 is moved due to the collision with the flow of the liquid supplied from the pressurizing chamber 10 to the ejection hole 8. Therefore, a configuration can be adopted in which the region where the liquid stagnates is less likely to appear inside the pressurizing chamber 10.

The pressurizing chamber 10 has the pressurizing chamber body 10*a* and the partial flow path 10*b*. The first individual flow path 12 is connected to the pressurizing chamber body 10*a*, and the second individual flow path 14 is connected to the partial flow path 10*b*. Therefore, the first individual flow path 12 supplies the liquid so that the liquid flows in the whole pressurizing chamber 10, and due to the flow of the liquid supplied from the second individual flow path 14, the region where the liquid stagnates is less likely to appear in the partial flow path 10*b*.

The third individual flow path 16 is connected to the partial flow path 10*b*. Therefore, a configuration is adopted as follows. The flow of the liquid flowing from the second individual flow path 14 toward the third individual flow path 16 traverses the inside of the partial flow path 10*b*. As a result, the liquid flowing from the second individual flow path 14 toward the third individual flow path 16 can be caused to flow so as to traverse the flow of the liquid supplied from the pressurizing chamber body 10*a* to the ejection hole 8. Therefore, the region where the liquid stagnates is much less likely to appear inside the partial flow path 10*b*.

(Details and Operation of Individual Flow Path)

The third individual flow path 16 is connected to the partial flow path 10*b*, and is connected to the pressurizing chamber body 10*a* side from the second individual flow path 14. Therefore, even when air bubbles enter the inside of the partial flow path 10*b* from the ejection hole 8, the air bubbles can be discharged to the third individual flow path 16 by utilizing buoyancy of the air bubbles. In this manner, it is possible to reduce a possibility that the air bubbles stagnating inside the partial flow path 10*b* affect the pressure propagation to the liquid.

In a plan view, the first individual flow path 12 is connected to the pressurizing chamber body 10*a* in the first direction D1, and the second individual flow path 14 is connected to the partial flow path 10*b* in the fourth direction D4.

Therefore, in a plan view, the liquid is supplied to the ejection unit 15 from both sides in the first direction D1 and the fourth direction D4. Therefore, the supplied liquid has a velocity component in the first direction D1 and a velocity component in the fourth direction D4. Therefore, the liquid supplied to the pressurizing chamber 10 agitates the liquid inside the partial flow path 10*b*. As a result, the region where the liquid stagnates is less likely to appear inside the partial flow path 10*b*.

The third individual flow path 16 is connected to the partial flow path 10*b* in the first direction D1, and the ejection hole 8 is located in the partial flow path 10*b* in the fourth direction D4. In this manner, the liquid can also flow in the first direction D1 of the partial flow path 10*b*, and the region where the liquid stagnates is less likely to appear inside the partial flow path 10*b*.

A configuration may be adopted as follows. The third individual flow path 16 is connected to the partial flow path 10*b* in the fourth direction D4, and the ejection hole 8 is located in the partial flow path 10*b* in the first direction D1. Even in this case, the same advantageous effect can be achieved.

As illustrated in FIG. 8, the third individual flow path 16 is connected to the pressurizing chamber body 10*a* of the second common flow path 24. In this manner, the air bubbles discharged from the partial flow path 10*b* can flow along the upper surface of the second common flow path 24. In this manner, the air bubbles are likely to be discharged from the second common flow path 24 via the opening 24*a* (refer to FIG. 6).

It is preferable that the upper surface of the third individual flow path 16 and the upper surface of the second common flow path 24 are flush with each other. In this manner, the air bubbles discharged from the partial flow path 10*b* flow along the upper surface of the third individual flow path 16 and the upper surface of the second common flow path 24. Accordingly, the air bubbles are more likely to be discharged outward.

The second individual flow path 14 is connected to the ejection hole 8 of the partial flow path 10*b* from the third individual flow path 16. In this manner, the liquid is supplied from the second individual flow path 14 in the vicinity of the ejection hole 8. Therefore, the flow velocity of the liquid in the vicinity of the ejection hole 8 can be quickened, and precipitation of pigments contained in the liquid is suppressed. Therefore, the ejection hole 8 is less likely to be clogged.

As illustrated in FIG. 7B, in a plan view, the first individual flow path 12 is connected to the pressurizing chamber body 10*a* in the first direction D1, and an area centroid of the partial flow path 10*b* is located in the fourth direction D4 from the area centroid of the pressurizing chamber body 10*a*. That is, the partial flow path 10*b* is connected far from the first individual flow path 12 of the pressurizing chamber body 10*a*.

In this manner, the liquid supplied to the pressurizing chamber body 10*a* in the first direction D1 spreads to the entire region of the pressurizing chamber body 10*a*, and thereafter, is supplied to the partial flow path 10*b*. As a result, the region where the liquid stagnates is less likely to appear inside the pressurizing chamber body 10*a*.

In a plan view, the ejection hole 8 is located between the second individual flow path 14 and the third individual flow path 16. In this manner, when the liquid is ejected from the ejection hole 8, it is possible to move a position where the flow of the liquid supplied from the pressurizing chamber body 10*a* to the ejection hole 8 and the flow of the liquid supplied from the second individual flow path 14 collide with each other.

That is, the ejection amount of the liquid supplied from the ejection hole 8 varies depending on an image to be printed. The behavior of the liquid inside the partial flow path 10*b* is changed in response to an increase or a decrease in the ejection amount of the liquid. Therefore, due to the increase or the decrease in the ejection amount of the liquid, the position where the flow of the liquid supplied from the pressurizing chamber body 10*a* to the ejection hole 8 and the flow of the liquid supplied from the second individual flow path 14 collide with each other is moved. Therefore, the region where the liquid stagnates is less likely to appear inside the partial flow path 10*b*.

The area centroid of the ejection hole 8 is located in the fourth direction D4 from the area centroid of the partial flow path 10*b*. In this manner, the liquid supplied to the partial flow path 10*b* spreads to the whole region of the partial flow path 10*b*, and thereafter, is supplied to the ejection hole 8. Therefore, the region where the liquid stagnates is less likely to appear inside the partial flow path 10*b*.

Here, the ejection unit 15 is connected to the first common flow path 20 (fourth flow path) via the first individual flow path 12 (first flow path) and the second individual flow path 14 (second flow path). Therefore, the pressure applied to the pressurizing chamber body 10*a* is partially propagated to the first common flow path 20 via the first individual flow path 12 and the second individual flow path 14.

In the first common flow path 20, if a pressure wave is propagated from the first individual flow path 12 and the second individual flow path 14 and a pressure difference is generated inside the first common flow path 20, there is a possibility that the behavior of the liquid in the first common flow path 20 may become unstable. Therefore, it is preferable that a magnitude of the pressure wave propagated to the first common flow path 20 is uniform.

In the liquid ejection head 2, in a sectional view, the second individual flow path 14 is located below the first individual flow path 12. Therefore, the distance from the pressurizing chamber body 10*a* in the second individual flow path 14 is longer than the distance from the pressurizing chamber body 10*a* in the first individual flow path 12. Accordingly, when the pressure wave is propagated to the second individual flow path 14, pressure attenuation occurs.

The flow path resistance of the second individual flow path 14 is lower than the flow path resistance of the first individual flow path 12. Accordingly, the pressure attenuation when the liquid flows in the second individual flow path 14 can be set to be smaller than the pressure attenuation when the liquid flows in the first individual flow path 12. As a result, the magnitude of the pressure wave propagated from the first individual flow path 12 and the second individual flow path 14 can be substantially uniform.

That is, the sum of the pressure attenuation from the pressurizing chamber body 10*a* to the first individual flow path 12 or to the second individual flow path 14 and the pressure attenuation when the liquid flows in the first individual flow path 12 or the second individual flow path 14 can be substantially uniform between the first individual flow path 12 and the second individual flow path 14, and the magnitude of the pressure wave propagated to the first common flow path 20 can be substantially uniform.

In a sectional view, the third individual flow path 16 is located higher than the second individual flow path 14, and is located lower than the first individual flow path 12. In other words, the third individual flow path 16 is located between the first individual flow path 12 and the second individual flow path 14. Therefore, when the pressure applied to the pressurizing chamber body 10*a* is propagated to the third individual flow path 16, a portion of the pressure is propagated to the third individual flow path 16.

In contrast, the flow path resistance of the second individual flow path 14 is lower than the flow path resistance of the first individual flow path 12. Therefore, even though the pressure wave reaching the second individual flow path 14 decreases, the pressure attenuation decreases in the second individual flow path 14. Accordingly, the magnitude of the pressure wave propagated from the first individual flow path 12 and the second individual flow path 14 can be substantially uniform.

The flow path resistance of the first individual flow path 12 can be set to 1.03 to 2.5 times the flow path resistance of the second individual flow path 14.

The flow path resistance of the second individual flow path 14 may be set to be higher than the flow path resistance of the first individual flow path 12. In this case, a configuration can be adopted in which the pressure is less likely to be propagated from the first common flow path 20 via the second individual flow path 14. As a result, it is possible to reduce a possibility that unnecessary pressure may be propagated to the ejection hole 8.

The flow path resistance of the second individual flow path 14 can be set to 1.03 to 2.5 times the flow path resistance of the first individual flow path 12.

(Length of Annular Flow Path)

Figure 10:
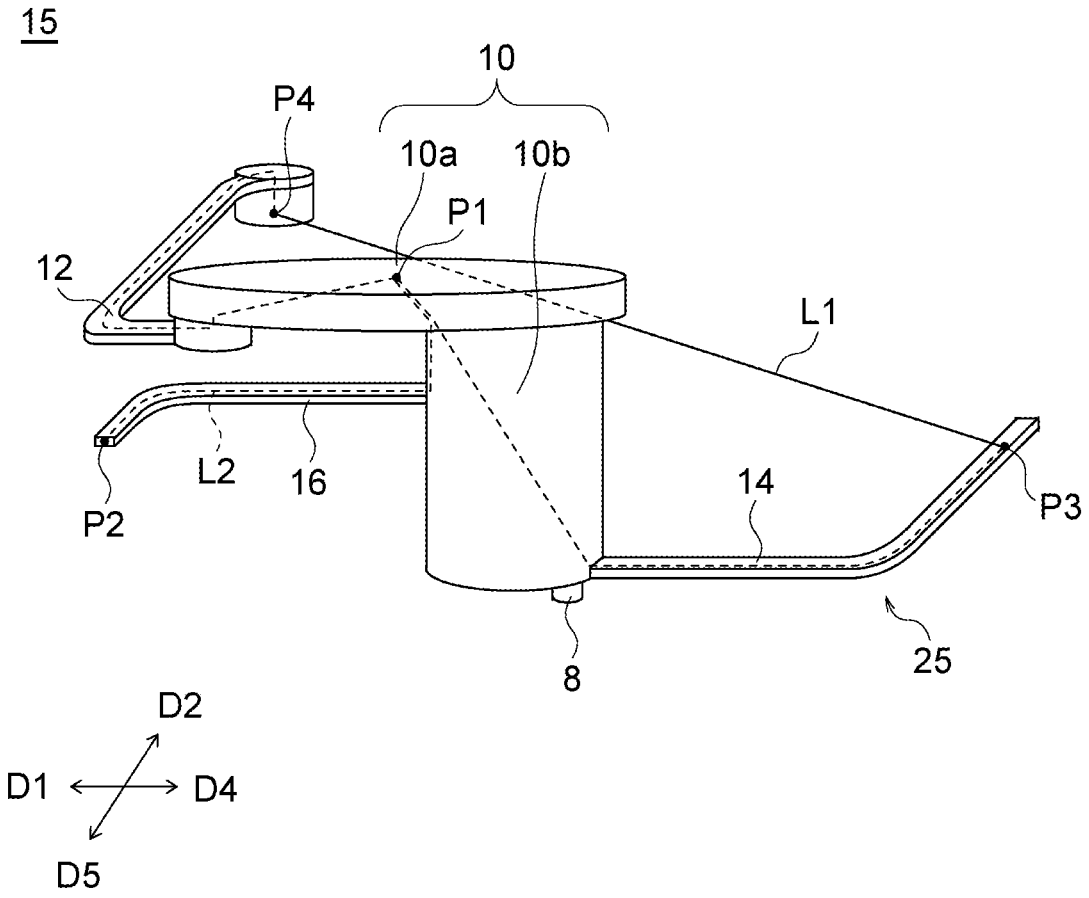
FIG. 10 is a perspective view for describing each length of an annular flow path and a third individual flow path.

A length of the flow path will be described with reference to FIG. 10. With regard to the respective ejection units 15, the pressurizing chamber 10, the first individual flow path 12, the first common flow path 20 (one branch flow path of a manifold), and the second individual flow path 14 are connected in this order, thereby configuring the annular flow path 25. A length L1 (length of an annular line passing through P1, P3, and P4) circulating once around the annular flow path 25 is longer than twice a length L2 (length of a line extending from P1 to P2) in which the fluid reaches the second common flow paths 24 from the pressurizing chamber body 10*a* after passing through the third individual flow path 16. The length L1 is an example of a first length, and the length L2 is an example of a second length.

Here, if the pressurizing chamber body 10*a* is pressurized by the displacement element 48 in order to eject the droplets, pressure waves are generated, and the pressure waves are respectively propagated to the first individual flow path 12, the second individual flow path 14, and the third individual flow path 16. Pressure resistance varies at a position where the flow paths are connected to each other. Accordingly, some of the pressure waves reflect at a connection position between the flow paths, and the other pressure waves are transmitted through the connection position. Therefore, some of the pressure waves propagated to the first individual flow path 12 and/or the second individual flow path 14 return to the pressurizing chamber body 10*a* after circulating once around the annular flow path 25. Some of the pressure waves propagated to the third individual flow path 16 are reflected at the connection position between the third individual flow path 16 and the second common flow path 24, and return to the pressurizing chamber body 10*a*.

The length L1 is longer than twice the length L2. Accordingly, a time for the pressure wave circulating once around the annular flow path 25 to return to the pressurizing chamber body 10*a* is late than a time for the pressure wave reciprocating in the third individual flow path 16 to return to the pressurizing chamber body 10*a*. In this manner, it is possible to reduce a possibility that the two pressure waves may be superimposed on each other in the pressurizing chamber body 10*a*. That is, it is possible to reduce a possibility that the pressure fluctuations remaining after the liquid ejection may increase in the pressurizing chamber body 10*a*. As a result, for example, it is possible to reduce the influence of the remaining pressure fluctuations on the subsequent droplet ejection, and the ejection accuracy is improved. Instead of setting twice the length L2 to be longer than the length L1, the length L1 is set to be longer than twice the length L2. Accordingly, for example, the length L1 can be secured in the first common flow path 20. As a result, it is easy to lengthen the length L1, and an advantageous effect (to be described later) can be achieved, since the length in the first common flow path 20 of the length L1 is relatively long.

Specifically, the length L1 and the length L2 may be measured as follows, for example. In each of the first individual flow path 12, the second individual flow path 14, and the third individual flow path 16, the length in the center line of the flow path is measured. The reason is as follows. The flow paths have a relatively small cross-sectional area, and the pressure waves are propagated substantially along the flow path. Accordingly, an average (representative) length of the flow paths may be measured. The center line of the flow path is a line obtained by connecting the area centroids of the cross sections perpendicular to the flow paths. In the pressurizing chamber 10 and the first common flow path 20, the length is basically measured using the shortest distance. In the spaces, while the pressure waves spread in all directions, the pressure waves are propagated to the individual flow path by basically using the shortest distance, and/or are propagated from the individual flow path.

A route for measuring the length in the pressurizing chamber 10 of the length L1 and the length L2 includes an area centroid P1 of the upper surface (surface pressurized by the displacement element 48, deflection of the piezoelectric actuator board 40 may be ignored) of the pressurizing chamber body 10*a* on the route. For example, the length in the pressurizing chamber 10 of the length L1 is the sum of the shortest distance from the area centroid P1 to the first individual flow path 12 and the shortest distance from the area centroid P1 to the second individual flow path 14. The length in the pressurizing chamber 10 of the length L2 is the shortest distance from the area centroid P1 to the third individual flow path 16. The area centroid P1 is a position representing a range where the pressure waves are generated, and a position representing a range where the subsequent droplet ejection is affected by the returning pressure waves. The length is specified with reference to the position. In this manner, it is possible to more reliably achieve the above-described advantageous effect of reducing the influence of the pressure fluctuations due to the two pressure waves on the subsequent droplet ejection. To be confirmative, the area centroid is a position where a primary moment is 0 around the area centroid.

As described above, the length in the pressurizing chamber 10 and the first common flow path 20 of the length L1 and the length L2 is the shortest distance. Accordingly, depending on whether an obstacle is present or absent, the shortest distance is a linear distance or a distance of a bent route. In an example illustrated in FIG. 10, the shortest distance is as follows. The length from the area centroid P1 to the first individual flow path 12 is the linear distance. The length from the area centroid P1 to the second individual flow path 14 is the length of the route which linearly extends from the area centroid P1 in the first direction D1 of the partial flow path 10*b* and an upper edge portion and which linearly extends from the edge portion to second individual flow path 14. The length from the area centroid P1 to the third individual flow path 16 is the length of the route which linearly extends from the area centroid P1 in the first direction D1 of the partial flow path 10*b* and an upper edge portion and which linearly extends from the edge portion to the third individual flow path 16. The length in the first common flow path 20 of the length L1 is the linear distance.

Unlike the illustrated example, for example, the shortest distance from the area centroid P1 to the second individual flow path 14 or the shortest distance from the area centroid P1 to the third individual flow path 14 may be the linear distance. For example, the shortest distance in the first common flow path 20 of the length L1 may not be the linear distance since the width of the first common flow path 20 is narrowed at the arrangement position of the partial flow path 10*b*. The length L1 and the length L2 do not need to pass through an end portion of the individual flow path. For example, according to the present embodiment, the second individual flow path 14 extends so as to form a groove on the bottom surface of the first common flow path 20 (FIG. 8A). Accordingly, the length in the first common flow path 20 of the length L1 is set as the length from a position P3 of the second individual flow path 14 which is located in front of an end portion of the first common flow path 20 to the first individual flow path 12.

In the configuration in which the length L1 is longer than twice the length L2 as described above, the length in the first common flow path 20 of the length L1 (length from the position P3 to the position P4) occupies 30% or more of the length L1. That is, a ratio of the first common flow path 20 occupying the length L1 is relatively high.

Here, the pressure waves propagated from the first individual flow path 12 or the second individual flow path 14 to the first common flow path 20 attenuate by being scattered in the first common flow path 20 whose cross-sectional area is wider than that of the individual flow paths. Therefore, for example, the ratio of the first common flow path 20 is increased. In this manner, it is possible to decrease the pressure waves returning to the pressurizing chamber body 10*a* after circulating once around the annular flow path 25. As a result, for example, while it is possible to achieve an advantageous effect of reducing the pressure fluctuations by delaying the time for the pressure wave to return to the pressurizing chamber body 10*a*, the ejection accuracy can be improved. For example, the relatively long length L1 is secured in the first common flow path 20 having the large cross-sectional area. In this manner, it is possible to suppress an increase in the flow path resistance which is caused by the lengthened first individual flow path 12 or the lengthened second individual flow path 14. The length L1 is secured in four locations of the pressurizing chamber 10, the first individual flow path 12, the first common flow path 20, and the second individual flow path 14. Accordingly, the length in the first common flow path 20 is longer than the length obtained by equally dividing the length L1 into four. Therefore, it is possible to sufficiently increase the influence of the attenuation in the first common flow path 20.

According to the present embodiment, in the opening direction of the ejection hole 8, the third individual flow path 16 is located between the first individual flow path 12 and the second individual flow path 14.

Therefore, the first individual flow path 12 and the second individual flow path 14 which configure the annular flow path 25 are the two individual flow paths which are farthest apart from each other in the upward-downward direction out of the three individual flow paths. Therefore, in the pressurizing chamber 10 and/or the first common flow path 20, it becomes easy to secure the length of the annular flow path 25 in the upward-downward direction. That is, it becomes easy to lengthen the length L1. Since the length of the annular flow path 25 can be secured in the first common flow path 20, it becomes easy to increase the ratio of the length of the first common flow path 20 which occupies the length L1.

According to the present embodiment, the first common flow path 20 extends in the direction (first direction D1) perpendicular to the opening direction of the ejection hole 8. When viewed in the opening direction of the ejection hole 8, the first individual flow path 12 and the second individual flow path 14 which are connected to the same pressurizing chamber 10 extend from the first common flow path 20 to mutually the same side (fifth direction D5) in the width direction of the first common flow path 20.

Therefore, for example, a propagation direction of the pressure wave from the first individual flow path 12 to the first common flow path 20 and a propagation direction of the pressure wave from the first common flow path 20 to the second individual flow path 14 are likely to become reverse. As a result, the pressure wave is less likely to be propagated from the first individual flow path 12 to the second individual flow path 14. The pressure wave in a direction opposite to the above-described direction is similarly propagated. That is, the propagation of the pressure wave in the annular flow path 25 can be reduced.

According to the present embodiment, the first common flow path 20 extends in the direction (first direction D1) perpendicular to the opening direction of the ejection hole 8. When viewed in the opening direction of the ejection hole 8, the first individual flow path 12 and the second individual flow path 14 which are connected to the same pressurizing chamber 10 extend from the pressurizing chamber 10 to the mutually opposite sides (first direction D1 and fourth direction D4) in the flow path direction of the first common flow path 20, and thereafter, extend to mutually the same side (second direction D2) in the width direction of the first common flow path 20. The first individual flow path 12 and the second individual flow path 14 are connected to the first common flow path 20 at mutually different positions in the flow path direction of the first common flow path 20.

Therefore, for example, in a plan view, the annular flow path 25 traverses the pressurizing chamber 10, and causes the first common flow path 20 to extend in the flow path direction. As a result, for example, it becomes easy to secure the length L1 in the pressurizing chamber 10 and the first common flow path 20. The length secured in this way can be realized while each length of the first individual flow path 12 and the second individual flow path 14 is shortened. Therefore, for example, it becomes easy to increase the ratio of the length of the first common flow path 20 which occupies the length L1.

In the opening direction of the ejection hole 8, if the configuration in which the third individual flow path 16 is located between the first individual flow path 12 and the second individual flow path 14 is combined with the configuration in which the first individual flow path 12 and the second and individual flow path 14 extend from the pressurizing chamber 10 to mutually opposite sides in the flow path direction of the first common flow path 20, the length of the annular flow path 25 is more likely to be secured in the pressurizing chamber 10 and the first common flow path 20.

According to the present embodiment, the second common flow path 24 extends parallel to the first common flow path 20. When viewed in the opening direction of the ejection hole 8, the second individual flow path 14 and the third individual flow path 16 which are connected to the same pressurizing chamber 10 extend from the pressurizing chamber 10 to mutually opposite sides (in the first direction D1 and the fourth direction D4) in the flow path direction of the first common flow path 20, and extend to mutually opposite sides (in the second direction D2 and the fifth direction D5) in the width direction of the first common flow path 20.

Therefore, for example, the second individual flow path 14 and the third individual flow path 16 are shaped to be rotationally symmetric to each other in a plan view. Accordingly, it is easy to compare the length L1 of the annular flow path 25 including the second individual flow path 14 with the length L2 of the route including the third individual flow path 16.

(Relationship between Pressure Wave Propagation and Ejection Timing)

Figure 11:
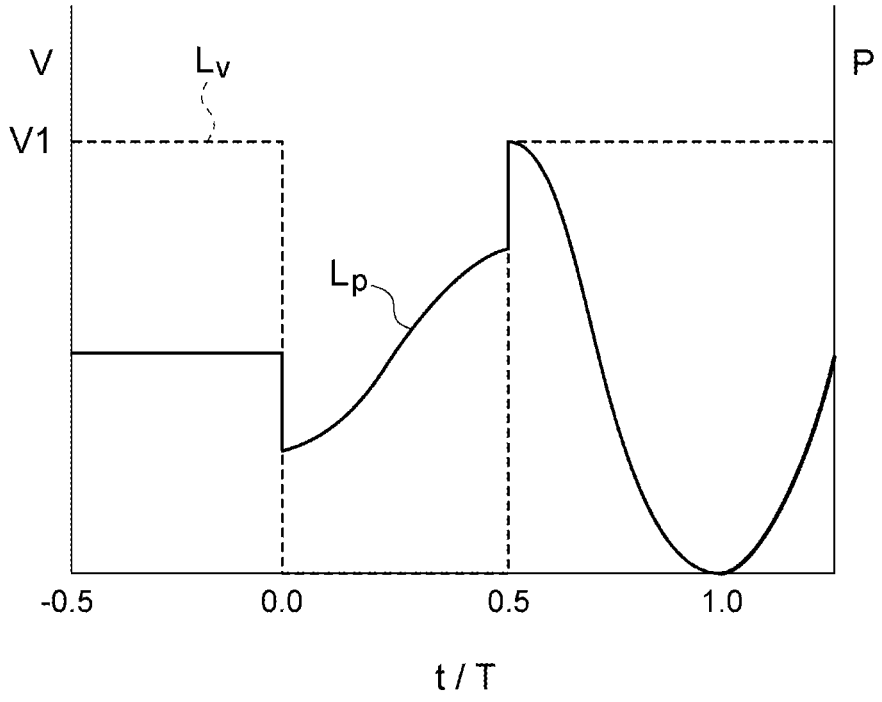
FIG. 11 is a view for describing an example of an ejection timing.

FIG. 11 is a view for describing an ejection timing of the droplets ejected by the liquid ejection head 2. The horizontal axis represents a value obtained in such a way that a time t is normalized using a natural period T of the vibration of the liquid in the pressurizing chamber 10. The vertical axis on the left side in the drawing represents a voltage V applied to the displacement element 48. As the vertical axis rises upward, a polarity voltage to deflect the piezoelectric actuator board 40 toward the pressurizing chamber body 10*a* becomes higher. The vertical axis on the right side in the drawing represents a pressure P of the liquid inside the pressurizing chamber body 10*a*. As the vertical axis rises upward, the pressure becomes higher. Specifically, the pressure of the liquid inside the pressurizing chamber body 10*a* is the pressure in the vicinity of the area centroid of the region facing the displacement element 48 of the pressurizing chamber body 10*a*. A line $L_v$ represents a change in the voltage V. A line $L_p$ represents a change in the pressure P.

FIG. 11 illustrates an example where so called pulling-type drive control is performed. Specifically, in a state where the droplets are not ejected from the ejection unit 15, the control unit 76 applies a predetermined voltage V1 to the common electrode 42 and the individual electrode 44 via the driver IC 62. In this manner, the piezoelectric actuator board 40 is deflected to the pressurizing chamber body 10*a*. When the droplets are ejected, first, the control unit 76 lowers the pressure of the liquid inside the pressurizing chamber body 10*a* by lowering the voltage (t/T=0). The pressurizing chamber body 10*a* whose pressure is lower than the pressure in a standard state suctions the liquid from the flow path (including the ejection hole 8) connected to the pressurizing chamber 10, and the pressure returns to the pressure in the standard state. At t/T=0.25, the pressure of the liquid inside the pressurizing chamber body 10*a* returns to the pressure in the standard state. However, the liquid continuously flows into the pressurizing chamber body 10*a*. Accordingly, the pressure conversely increases due to the liquid flowing into the pressurizing chamber body 10*a*. At t/T=0.5, the pressure of the liquid inside the pressurizing chamber 10 becomes highest so far. In this case, the control unit 76 raises the voltage. In this manner, the pressure of the pressurizing chamber body 10*a* increases. The pressure raised before the voltage is raised and the pressure generated by applying the voltage are added. Accordingly, the pressure generated here becomes twice the pressure generated by the voltage change of V1. The pressure is transmitted from the pressurizing chamber body 10*a* to the flow path connected to the pressurizing chamber body 10*a*. Due to the pressure reaching the ejection hole 8 in the pressure, a portion of the liquid inside the ejection hole 8 is pushed outward, and is ejected as the droplets.

The pressure wave generated in the pressurizing chamber body 10*a* and returning to the pressurizing chamber body 10*a* after circulating once around the annular flow path 25, and the pressure wave generated in the pressurizing chamber body 10*a* and returning to the pressurizing chamber body 10*a* after reciprocating in the third individual flow path 16 start to be generated when the driving starts (t/T=0), for example. Since the lengths L1 and L2 are set to be relatively long, the pressure waves return to the pressurizing chamber body 10*a* (more specifically, the area centroid P1, for example) after the droplets are ejected, for example. Specifically, for example, the droplets are substantially completely ejected until a time point at which the pressure P becomes lowest (t/T=1.0), and thereafter (after t/T=1.0), the pressure waves return to the pressurizing chamber body 10*a*.

Second Embodiment

Figure 12A:
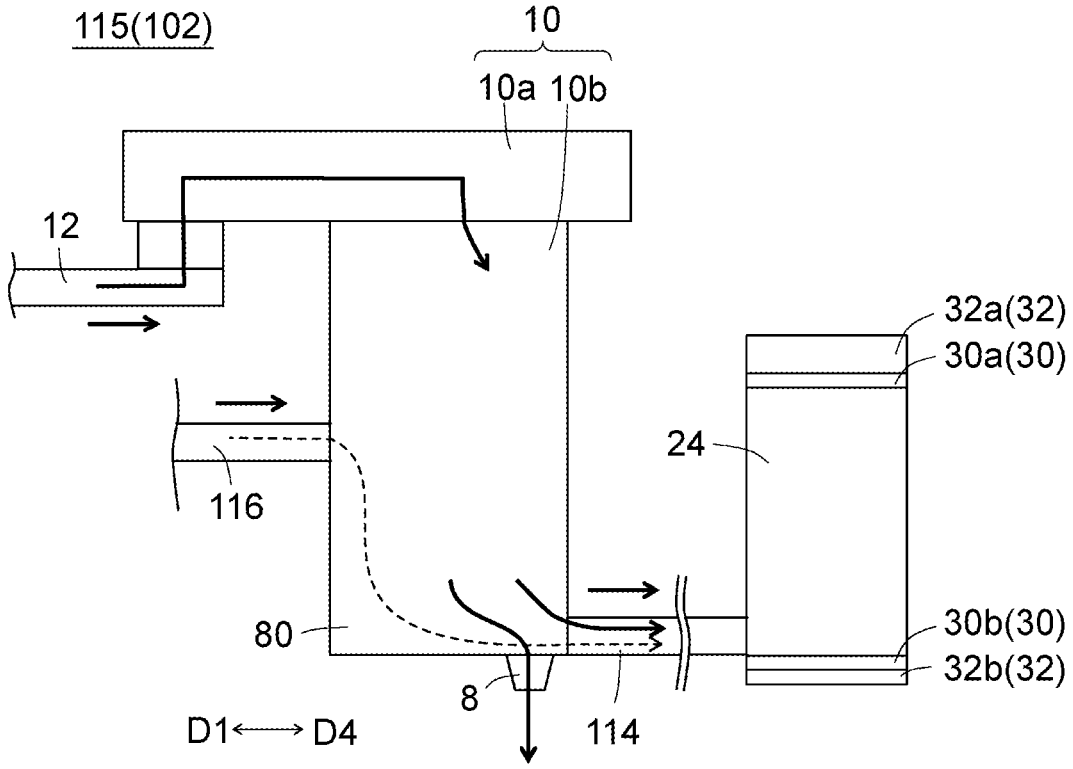
FIG. 12A is a conceptual diagram illustrating a flow of a fluid inside a liquid ejection unit.
Figure 12B:
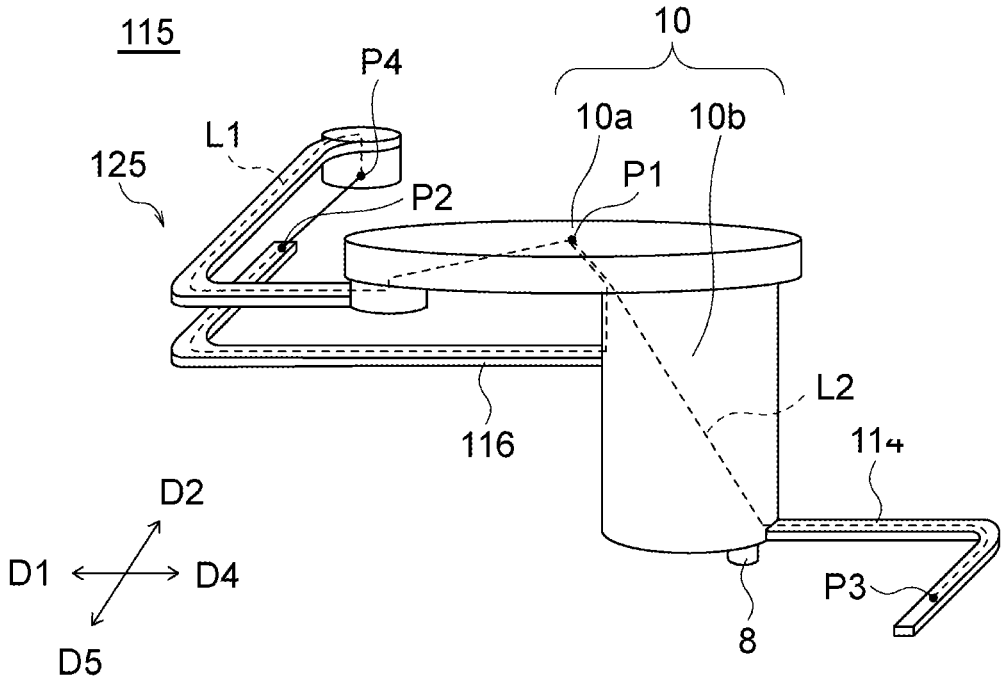
FIG. 12B is a perspective view of the liquid ejection unit.

A liquid ejection head 102 according to a second embodiment will be described with reference to FIG. 12. In the liquid ejection head 102, a configuration of an ejection unit 115 is different from that of the liquid ejection head 2, and other configurations are the same as those of the liquid ejection head 2. In FIG. 12A, similar to FIG. 9, an actual flow of the liquid is indicated using a solid line, and a flow of the liquid supplied from the third individual flow path 116 is indicated using a broken line.

The ejection unit 115 includes the ejection hole 8, the pressurizing chamber 10, the first individual flow path (first flow path) 12, the second individual flow path (third flow path) 114, and the third individual flow path (second flow path) 116. The first individual flow path 12 and the third individual flow path 116 are connected to the first common flow path 20 (fourth flow path), and the second individual flow path 114 is connected to the second common flow path 24 (fifth flow path). Therefore, the liquid is supplied to the ejection unit 115 from the first individual flow path 12 and the third individual flow path 116, and the liquid is collected from the second individual flow path 114.

In the liquid ejection head 102, in a plan view, the first individual flow path 12 is connected to the pressurizing chamber body 10*a* in the first direction D1, the second individual flow path 114 is connected to the partial flow path 10*b* in the fourth direction D4, and the third individual flow path 116 is connected to the partial flow path 10*b* in the first direction D1.

Therefore, in a plan view, the liquid is supplied to the ejection unit 115 from the first direction D1, and the liquid is collected from the fourth direction D4. In this manner, the liquid inside the partial flow path 10*b* can be caused to efficiently flow from the first direction D1 to the fourth direction D4. Accordingly, the region where the liquid stagnates is less likely to appear inside the partial flow path 10*b*.

That is, the third individual flow path 116 is connected to the partial flow path 10*b* located below the pressurizing chamber body 10*a*. Accordingly, the liquid flows in the vicinity of the region 80 as indicated by the broken line. As a result, the liquid can flow in the region 80 located opposite to a portion connected to the second individual flow path 114. Therefore, the region where the liquid stagnates is less likely to appear inside the partial flow path 10*b*.

The pressurizing chamber 10, the first individual flow path 12, the first common flow path 20, and the third individual flow path 116 configure the annular flow path 125. The first length L1 (length of the line passing through P1, P2, and P4) in which the pressure wave returns to the area centroid P1 after circulating once around the annular flow path 125 from the area centroid P1 on the surface pressurized by the displacement element 48 of the pressurizing chamber 10 is longer than twice the second length L2 (length of the line extending from P1 to P3) in which the pressure wave reaches the second common flow path 24 after passing through the second individual flow path 114 from the area centroid P1.

Therefore, similarly to the first embodiment, a period during which the pressure wave circulating once around the annular flow path 125 returns to the pressurizing chamber body 10*a* is late than a period during which the pressure wave reciprocating in the second individual flow path 114 returns to the pressurizing chamber body 10*a*. As a result, for example, a possibility that the pressure fluctuations may increase in the pressurizing chamber body 10*a* is reduced, and the ejection accuracy is improved.

As will be understood from the second embodiment, the third flow path (second individual flow path 114) does not need to be located between the first flow path (first individual flow path 12) and the second flow path (third individual flow path 116) which configure the annular flow path. The first flow path and the second flow path do not need to extend from the pressurizing chamber to mutually opposite sides.

In the above-described embodiment, the displacement element 48 is an example of the pressurizing unit. The transport rollers 74*a* to 74*d* are examples of the transport unit.

Aspects of this disclosure are not limited to the above-described embodiments, and various modifications are available without departing from the gist of the disclosure.

The configuration of the flow path connected to the pressurizing chamber in order to supply or collect the liquid is not limited to the examples described in the embodiments. For example, in FIG. 9, the direction extending from the partial flow path 10*b* of the second individual flow path 14 and/or the third individual flow path 16 may be reversed to the illustrated direction. Alternatively, in FIG. 12A, the direction extending from the partial flow path 10*b* of the second individual flow path 114 and or the third individual flow path 116 may be reversed to the illustrated direction. The ejection hole 8 may be located in the first direction D1 with respect to the partial flow path 10*b*. In the embodiments, the first individual flow path 12 is used only for supplying the liquid, but may be used for collecting the liquid.

In the embodiment, the first flow path and the second flow path (for example, the first individual flow path 12 and the second individual flow path 14) which configure the annular flow path serve as the flow path for supplying the liquid to the pressurizing chamber, and the third flow path which does not configure the annular flow path serves as the flow path for collecting the liquid. Conversely, the first flow path and the second flow path may serve as the flow path for collecting the liquid from the pressurizing chamber, and the third flow path may serve as the flow path for supplying the liquid.

In the embodiment, in a plan view, the width (direction perpendicular to the first direction D1) of the individual flow path (for example, the second individual flow path 14 and the third individual flow path 16) connected to the partial flow path 10*b* is set to be smaller than the diameter of the partial flow path 10*b*. However, the width of the individual flow paths may be set to be equal to or larger than the diameter of the partial flow path 10*b* by widening the portion connected to the partial flow path 10*b*.

REFERENCE SIGNS LIST

1 color inkjet printer
2 liquid ejection head
2*a* head body
4 first flow path member
4*a* to 4*m* plate
4-1 pressurizing chamber surface
4-2 ejection hole surface
6 second flow path member
8 ejection hole
10 pressurizing chamber
10*a* pressurizing chamber body
10*b* partial flow path
12 first individual flow path (first flow path)
14 second individual flow path (second flow path)
15 ejection unit
16 third individual flow path (third flow path)
20 first common flow path (fourth flow path)
22 first integrated flow path
24 second common flow path (fifth flow path)
26 second integrated flow path
28 end portion flow path
30 damper
32 damper chamber
40 piezoelectric actuator board
42 common electrode
44 individual electrode
46 connection electrode
48 displacement element
50 housing
52 heat sink
54 wiring board
56 pressing member
58 elastic member
60 signal transmission unit
62 driver IC
70 head mounting frame
72 head group
74*a*, 74*b*, 74*c*, 74*d* transport roller
76 control unit
P recording medium
D1 first direction
D2 second direction
D3 third direction
D4 fourth direction
D5 fifth direction
D6 sixth direction

The invention claimed is:

1. A liquid ejection head comprising:

a flow path member comprising a plurality of ejection holes, a plurality of pressurizing chambers respectively connected to the plurality of ejection holes, a plurality of first flow paths respectively connected to the plurality of pressurizing chambers, a plurality of second flow paths respectively connected to the plurality of pressurizing chambers, a plurality of third flow paths respectively connected to the plurality of pressurizing chambers, a fourth flow path connected in common to the plurality of first flow paths and the plurality of second flow paths, and a fifth flow path connected in common to the plurality of third flow paths; and a plurality of pressurizing units for respectively pressurizing a liquid inside the plurality of pressurizing chambers, wherein in one of the plurality of first flow paths, one of the plurality of second flow paths, one of the plurality of third flow paths, which are connected to one of the plurality of pressurizing chambers, and one of the plurality of pressurizing units pressurizing a liquid inside the one of the plurality of pressurizing chambers, a first length of an annular flow path circulating from an area centroid of a surface pressurized by the one of the pressurizing units in the one of the pressurizing chambers through the one of the first flow paths, the fourth flow path, and the one of the second flow paths, in this order, to the area centroid, is longer than twice a second length extending from the area centroid to the fifth flow path via the one of the third flow paths.

2. The liquid ejection head according to claim 1, wherein a length in the fourth flow path of the first length occupies 30% or more of the first length.

3. The liquid ejection head according to claim 1, wherein the one of the third flow paths is located between the one of the first flow paths and the one of the second flow paths, in an opening direction of the plurality of ejection holes.

4. The liquid ejection head according to claim 1, wherein the fourth flow path extends in a direction perpendicular to an opening direction of the plurality of ejection holes, and the one of the first flow paths and the one of the second flow paths extend from the fourth flow path to an identical side in a width direction of the fourth flow path, when viewed in the opening direction.

5. The liquid ejection head according to claim 1, wherein the fourth flow path extends in a direction perpendicular to an opening direction of the plurality of ejection holes, and the one of the first flow paths and the one of the second flow paths extend from the one of the pressurizing chambers to mutually different sides in a flow path direction of the fourth flow path, extend to an identical side in a width direction of the fourth flow path, and are connected to the fourth flow path at mutually different positions in the flow path direction, when viewed in the opening direction.

6. The liquid ejection head according to claim 5, wherein the fifth flow path extends parallel to the fourth flow path, and the one of the second flow paths and the one of the third flow paths extend from the one of the pressurizing chambers to mutually opposite sides in the flow path direction of the fourth flow path and the fifth flow path, and extend to mutually opposite sides in the width direction of the fourth flow path and the fifth flow path, when viewed in the opening direction.

7. A recording apparatus comprising:

the liquid ejection head according to claim 1;

a transport unit that transports a recording medium to the liquid ejection head; and a control unit that controls the liquid ejection head.

* * * * *